US011643239B2

(12) United States Patent
Yoneda et al.

(10) Patent No.: US 11,643,239 B2
(45) Date of Patent: May 9, 2023

(54) PAPER CONTAINER

(71) Applicant: NIPPON PAPER INDUSTRIES CO., LTD., Tokyo (JP)

(72) Inventors: Yoshitaka Yoneda, Tokyo (JP); Kouya Nakamura, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 0 days.

(21) Appl. No.: 17/277,874

(22) PCT Filed: Sep. 20, 2019

(86) PCT No.: PCT/JP2019/037133
§ 371 (c)(1),
(2) Date: Mar. 19, 2021

(87) PCT Pub. No.: WO2020/059883
PCT Pub. Date: Mar. 26, 2020

(65) Prior Publication Data

US 2021/0347521 A1 Nov. 11, 2021

(30) Foreign Application Priority Data

Sep. 21, 2018 (JP) ..... JP2018-178030

(51) Int. Cl.
*B65D 5/06* (2006.01)
*B65D 5/40* (2006.01)
*B65D 5/64* (2006.01)

(52) U.S. Cl.
CPC ..... *B65D 5/061* (2013.01); *B65D 5/40* (2013.01); *B65D 5/64* (2013.01)

(58) Field of Classification Search
CPC . B65D 5/061; B65D 5/40; B65D 5/64; B65D 5/746; B65D 5/029; B65D 5/067; B65D 5/46072; B65D 5/06; B65B 51/144
(Continued)

(56) References Cited

U.S. PATENT DOCUMENTS 4,795,086 A * 1/1989 Farber ..... B65D 5/064 229/920
5,350,110 A * 9/1994 Will ..... B65D 5/061 229/137

(Continued)

FOREIGN PATENT DOCUMENTS

EP 1275588 A1 * 1/2003 ..... B65D 5/067

*Primary Examiner* — Christopher R Demeree
(74) *Attorney, Agent, or Firm* — Wenderoth, Lind & Ponack, L.L.P.

(57) ABSTRACT

A paper container having a top portion (4) that is tightly closed by bonding together opposing surfaces of first top sealing panels (20) and opposing surfaces of second top sealing panels (22), and each of side panels (16) is folded along a first side panel folding line (26) and a second side panel folding line (27) to form a flap (35) having a substantially triangular shape. The top portion (4) is formed by folding down the flaps (35) onto right and left side surfaces of a tubular body (3) through mountain-folding along front-side top panel vertical folding lines (17), front-side top panel vertical folding lines (18), and front-side top sealing vertical folding lines (23), and through valley-folding along second top portion horizontal folding lines (15) and back-side top sealing vertical folding lines (24).

7 Claims, 22 Drawing Sheets

(58) Field of Classification Search
USPC ..... 229/132, 137, 125.42, 5.85, 125.15; 222/81; 493/183; 53/565
See application file for complete search history.

(56) References Cited

U.S. PATENT DOCUMENTS

| | | | | |
|---|---|---|---|---|
| 7,934,637 | B2 * | 5/2011 | Kaneko | B65D 5/746 229/125.42 |
| 8,584,927 | B2 * | 11/2013 | Rimondi | B65B 49/08 229/137 |
| 10,850,887 | B2 * | 12/2020 | Dammers | B65D 5/029 |
| 2004/0169066 | A1 * | 9/2004 | Palm | B65D 5/067 229/110 |
| 2020/0095012 | A1 * | 3/2020 | Nakamura | B65D 5/064 |
| 2021/0323718 | A1 * | 10/2021 | Nakamura | B65D 5/746 |

* cited by examiner

PAPER CONTAINER

TECHNICAL FIELD

The present invention relates to a paper container having a flat top-type top portion (including a brick-type paper container), which is configured to store a liquid beverage such as milk or juice.

BACKGROUND ART

Hitherto, a flat top-type paper container has been widely used. As a paper container configured to store a liquid beverage such as milk or juice, the flat top-type paper container is formed of a single carton blank and includes four body panels. On a body formed into a quadrangular tubular shape through sealing with a vertical direction sealing panel, the flat top-type paper container has a top portion formed of a pair of top panels and a pair of side panels folded on a side surface of the top panels. Below the body, the flat top-type paper container has a bottom portion formed of a pair of bottom panels and a pair of inner panels folded on an inner side of the bottom panels (see, for example, Patent Literature 1 and Patent Literature 2).

Formation of a top of the paper container of this type is described in detail. First, an upper opening of the body formed into the tubular shape is closed by bonding together top sealing panels contiguous with upper ends of the pair of top panels and an upper end of the pair of the side panels. Next, the carton blank is mountain-folded along horizontal folding lines formed between the pair of top panels and the body so as to fold down the top seal panel to a back side of the paper container, and the pair of side panels are folded to form flaps each having a triangular shape. The flaps are folded down and bonded to side surfaces of the paper container, respectively. Thus, the flat top-type top portion is formed.

CITATION LIST

Patent Literature

[PTL 1] JP 2017-24741 A
[PTL 2] JP 2016-169025 A

SUMMARY OF INVENTION

Technical Problem

Each of the flaps, which is folded down onto the side surface in formation of the top portion of the paper container, is formed of the side panel folded in layers and the top sealing panel bonded in layers, and hence has a thickness four times as large as a thickness of the carton blank. Thus, a strong repulsive force is generated against folding down of the flap.

However, hitherto, in the paper container of this type, the top sealing panels continuous with the pair of top panels and the pair of side panels each have the same width in a right-and-left direction of the paper container as a width of the body in the right-and-left direction. Under a state in which the respective panels are folded in layers before each flap is folded down, folding lines formed at end portions of the respective panels are aligned in an up-and-down direction of the paper container. Accordingly, a positional displacement amount of the folding line from an apex of a folding-down corner portion of the flap becomes larger to an outer surface side of the flap, and hence the repulsive force against folding down of the flap cannot be reduced.

When the repulsive force against folding down of the flap cannot be reduced, the flap cannot easily be folded down. In addition, the folded-down flap pulls the tubular body to an outer side of the paper container in the right-and-left direction due to the repulsive force against the folded-down flap, and hence causes a bulge of the body of the paper container.

Further, at this time, the flaps form an inverted V shape, and protrude rightward and leftward.

Further, the repulsive force, which is generated against folding down of the flap, is also generated in the top sealing panels forming the top portion. Thus, the top sealing panels are curved so that a gap is defined between the top sealing panels and the back-side top panel.

When the bulge of the body and warp of the flap are thus caused in the paper container, there arises a trouble in that the paper container has a superfluous width at the time of storage and conveyance, the flap is caught, or the like. As a result, there is a problem in that work cannot smoothly be performed.

Further, when an end portion of the flap warped by being caught is subjected to a strong force, there is a problem in that the flap is separated from the body so that a shape of the top portion of the paper container cannot be maintained.

Further, there is a problem in that the bulge of the body, or the gap defined in the top portion between the top sealing panels and the back-side top panel significantly degrades a design of the paper container.

It is an object of the present invention to provide a paper container causing no hindrance to storage and conveyance, having an excellent design, and having a configuration capable of reducing a repulsive force against folding down of a flap. With this configuration, warp of the flap is suppressed, and a bulge of a body is prevented.

Solution to Problem

In order to achieve the above-mentioned object, according to a first aspect of the invention, there is provided a paper container, including: a body front panel, a body right side panel, a body left side panel, and a body back panel, which are contiguous through body vertical folding lines; a vertical direction sealing panel configured to form a rectangular tubular body; a pair of top panels contiguous with an upper end of the body front panel and an upper end of the body back panel so as to be opposed to the body front panel and the body back panel through first top portion horizontal folding lines, respectively; a pair of side panels contiguous with an upper end of the body right side panel and an upper end of the body left side panel so as to be opposed to the body right side panel and the body left side panel through second top portion horizontal folding lines, respectively, the pair of top panels and the pair of side panels being contiguous with each other through front-side top panel vertical folding lines and back-side top panel vertical folding lines; a pair of first top sealing panels contiguous with upper ends of the pair of top panels so as to be opposed to the pair of top panels through top sealing horizontal folding lines, respectively; and second top sealing panels contiguous with upper ends of the pair of side panels so as to be opposed to the pair of side panels through top sealing horizontal folding lines, respectively, the first top sealing panels and the second top sealing panels being contiguous with each other through front-side top sealing vertical folding lines and back-side top sealing vertical folding lines, the second top sealing panels each having a side top sealing vertical folding line extending from an upper end of the second top sealing panel to the top sealing horizontal folding line, the pair of side panels each having a first side panel folding line extending from an intersection of the body vertical folding line and a front-side end portion of the second top portion horizontal folding line to an intersection of the top sealing horizontal folding line and the side top sealing vertical folding line, and a second side panel folding line extending from an intersection of the body vertical folding line and a back-side end portion of the second top portion horizontal folding line to the intersection of the top sealing horizontal folding line and the side top sealing vertical folding line, the second top sealing panels being folded along the side top sealing vertical folding lines so as to tightly close a top portion by bonding together opposing surfaces of the pair of first top sealing panels and opposing surfaces of the pair of second top sealing panels, each of the side panels being folded along the first side panel folding line and the second side panel folding line to form a flap having a substantially triangular shape, the top portion being formed by folding down the flaps onto right and left side surfaces of the tubular body through mountain-folding along the top panel vertical folding lines and the front-side top sealing vertical folding lines, and through valley-folding along the second top portion horizontal folding lines and the back-side top sealing vertical folding lines, wherein a width of a front-side top sealing panel of the first top sealing panels in a right-and-left direction of the paper container is larger than a width of the tubular body in the right-and-left direction.

According to a second aspect of the invention, in the paper container according to the first aspect of the invention, the width of the front-side top sealing panel in the right-and-left direction is larger than a width of a back-side top sealing panel of the first top sealing panels in the right-and-left direction.

According to a third aspect of the invention, in the paper container according to the first or second aspects of the invention, the front-side top panel vertical folding lines extend obliquely so as to gradually increase an interval between the front-side top panel vertical folding lines from the body front panel side toward the first top sealing panel, and join with the front-side top sealing vertical folding lines, respectively.

According to a fourth aspect of the invention, in the paper container according to any of the first through third aspects of the invention, a width of the back-side top sealing panel in the right-and-left direction is smaller than a width of the body front panel in the right-and-left direction.

According to a fifth aspect of the invention, in the paper container according to the fourth aspect of the invention, the back-side top panel vertical folding lines extend obliquely so as to gradually decrease an interval between the back-side top panel vertical folding lines from the body back panel side toward the first top sealing panel, and join with the back-side top sealing vertical folding lines, respectively.

According to a sixth aspect of the invention, in the paper container according to any of the first through third aspects of the invention, a width of the back-side top sealing panel in the right-and-left direction is larger than a width of the tubular body in the right-and-left direction.

According to a seventh aspect of the invention, in the paper container according to the sixth aspect of the invention, the back-side top panel vertical folding lines extend obliquely so as to gradually increase an interval between the back-side top panel vertical folding lines from the body back panel side toward the first top sealing panel, and join with the back-side top sealing vertical folding lines, respectively.

Advantageous Effects of Invention

With the paper container according to the first aspect of the invention, the width of the front-side top sealing panel of the first top sealing panels in the right-and-left direction is larger than the width of the tubular body in the right-and-left direction. Accordingly, the position of each of the front-side top sealing vertical folding lines can be close to the apex of the folding-down corner portion of the flap, which is located more on the outer side in the right-and-left direction than the outer surface of the right side panel or the left side panel of the tubular body. Thus, the flap can easily be folded down, thereby being capable of reducing the repulsive force against folding down of the flap.

With the paper container according to the second aspect of the invention, the width of the front-side top sealing panel in the right-and-left direction is larger than the width of the back-side top sealing panel of the first top sealing panels in the right-and-left direction. Accordingly, the position of each of the front-side top sealing vertical folding lines can be close to the apex of the folding-down corner portion of the flap, which is located more on the outer side in the right-and-left direction than the position of each of the back-side top sealing vertical folding lines. Thus, the flap can easily be folded down, thereby being capable of reducing the repulsive force against folding down of the flap.

With the paper container according to the third aspect of the invention, the front-side top panel vertical folding lines extend obliquely so as to gradually increase the interval between the front-side top panel vertical folding lines from the body front panel side toward the first top sealing panel, and join with the front-side top sealing vertical folding lines, respectively. Accordingly, the paper container can easily be assembled, which includes the front-side top sealing panel having the width in the right-and-left direction larger than the width of the back-side top sealing panel.

Further, the position of each of the front-side top panel vertical folding lines can be close to the apex of the folding-down corner portion of the flap, which is located more on the outer side in the right-and-left direction than the outer surface of the right side panel or the left side panel of the tubular body. Thus, the flap can easily be folded down, thereby being capable of reducing the repulsive force against folding down of the flap.

With the paper container according to the fourth aspect of the invention, the width of the back-side top sealing panel in the right-and-left direction is smaller than the width of the body front panel in the right-and-left direction. Accordingly, at a position at which the top sealing panels overlap each other when the flap is folded down, the body right side panel or the body left side panel is pushed inward so that the width of the tubular body in the right-and-left direction is reduced. Even when the width of the front-side top sealing panel in the right-and-left direction is set to the same dimension as the width of the body front panel in the right-and-left direction, the width of the front-side top sealing panel can be larger than the width of the back-side top sealing panel and the width of the tubular body in the right-and-left direction. Further, the position of each of the front-side top sealing vertical folding lines can be close to the apex of the folding-down corner portion of the flap, which is located more on the outer side in the right-and-left direction than each of the back-side top sealing vertical folding lines and the outer surface of the right side panel or the left side panel of the tubular body. Thus, the flap can easily be folded down, thereby being capable of reducing the repulsive force against folding down of the flap.

Further, the side surfaces of the body are pushed inward, thereby being capable of suppressing the bulge of the body of the paper container.

With the paper container according to the fifth aspect of the invention, the back-side top panel vertical folding lines extend obliquely so as to gradually decrease the interval between the back-side top panel vertical folding lines from the body back panel side toward the first top sealing panel, and join with the back-side top sealing vertical folding lines, respectively. Accordingly, the paper container can easily be assembled, which includes the back-side top sealing panel having the width smaller than the width of the tubular body in the right-and-left direction.

With the paper container according to the sixth aspect of the invention, the width of the back-side top sealing panel in the right-and-left direction is larger than the width of the tubular body in the right-and-left direction. Accordingly, the position of each of the back-side top sealing vertical folding lines can be close to the apex of the folding-down corner portion of the flap, which is located more on the outer side in the right-and-left direction than the position of the width of the tubular body in the right-and-left direction. Thus, the flap can easily be folded down, thereby being capable of reducing the repulsive force against folding down of the flap.

With the paper container according to the seventh aspect of the invention, the back-side top panel vertical folding lines extend obliquely so as to gradually increase the interval between the back-side top panel vertical folding lines from the body back panel side toward the first top sealing panel, and join with the back-side top sealing vertical folding lines, respectively. Accordingly, the paper container can easily be assembled, which includes the back-side top sealing panel having the width larger than the width of the tubular body in the right-and-left direction.

Further, each of the back-side top panel vertical folding lines can be formed at the position close to the apex of the folding-down corner portion of the flap, which is located more on the outer side in the right-and-left direction than the position of the width of the tubular body in the right-and-left direction. Thus, the flap can easily be folded down, thereby being capable of reducing the repulsive force against folding down of the flap.

DESCRIPTION OF EMBODIMENTS

Now, a paper container according to each embodiment of the present invention is described in detail with reference to the drawings.

Figure 1:
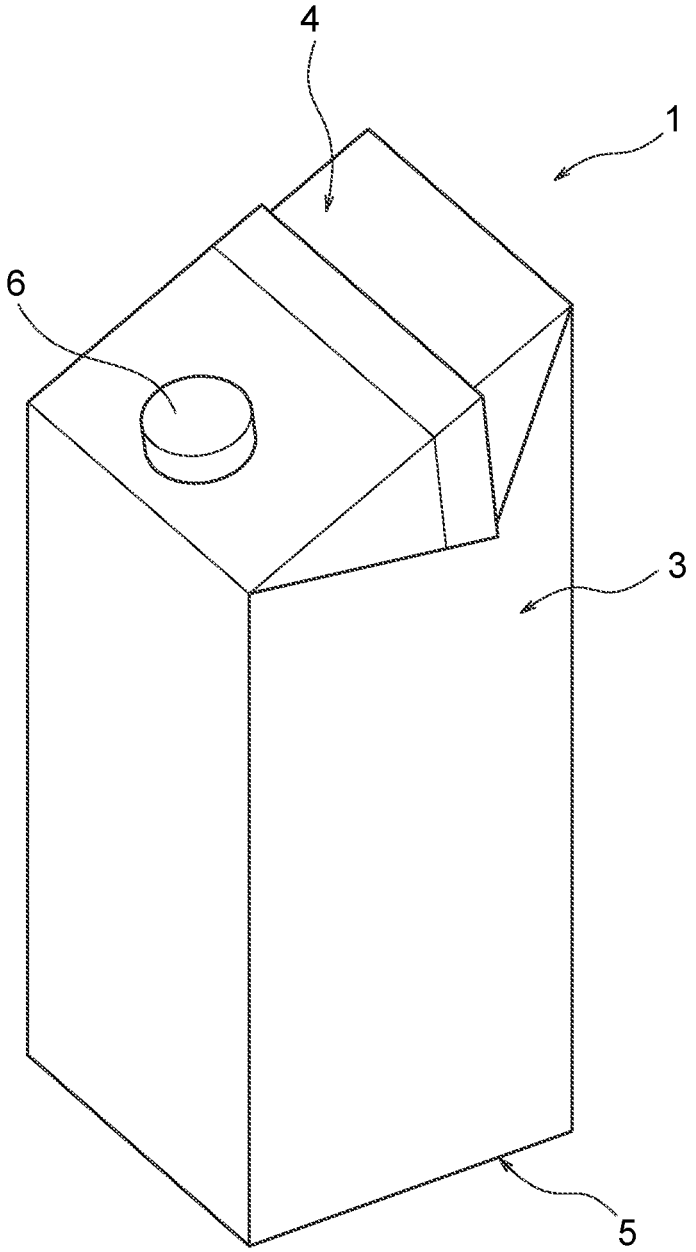
FIG. 1 is a perspective view for illustrating a first example of a paper container according to an embodiment of the present invention.
Figure 2:
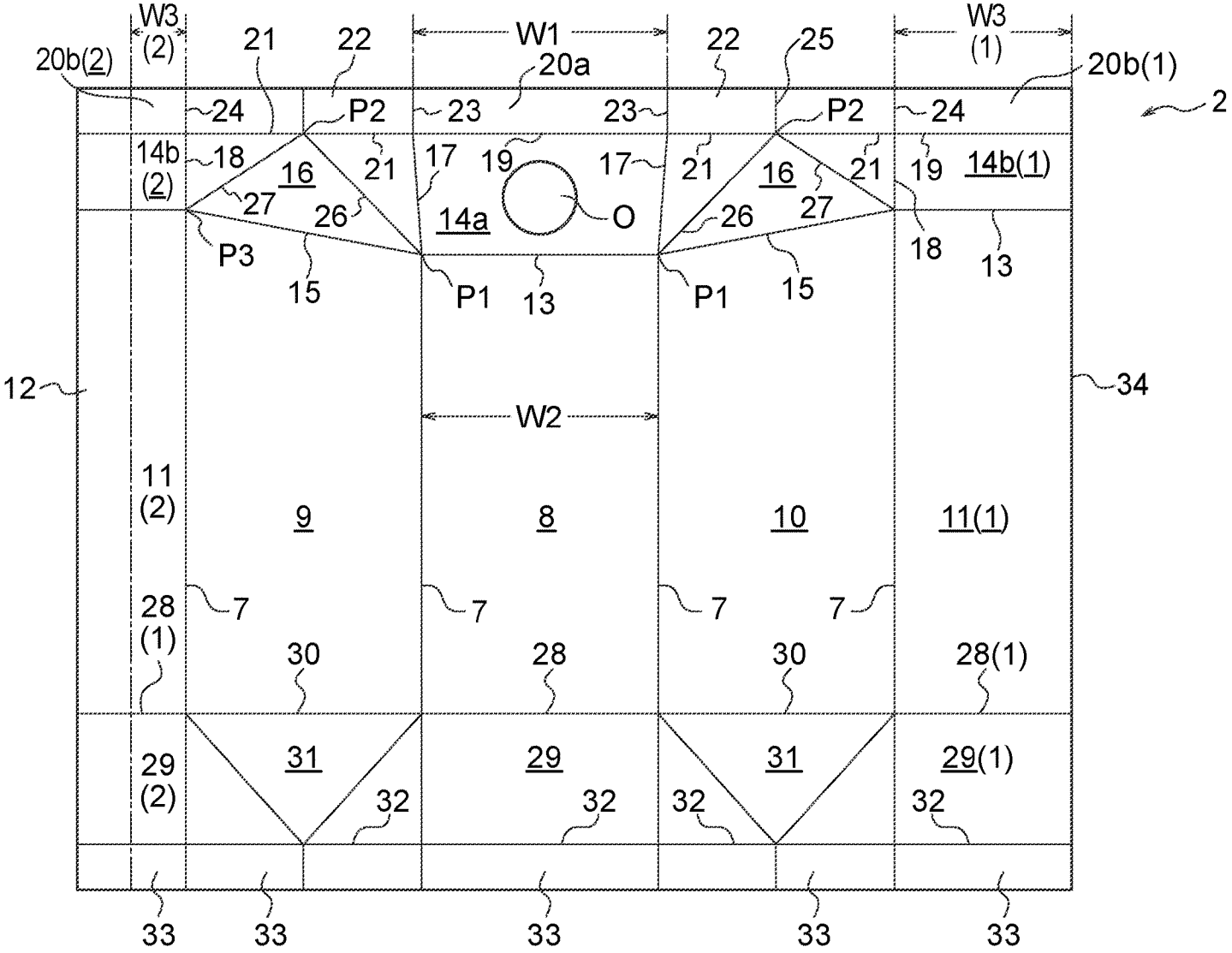
FIG. 2 is a developed view for illustrating the paper container of the first example.
Figure 3:
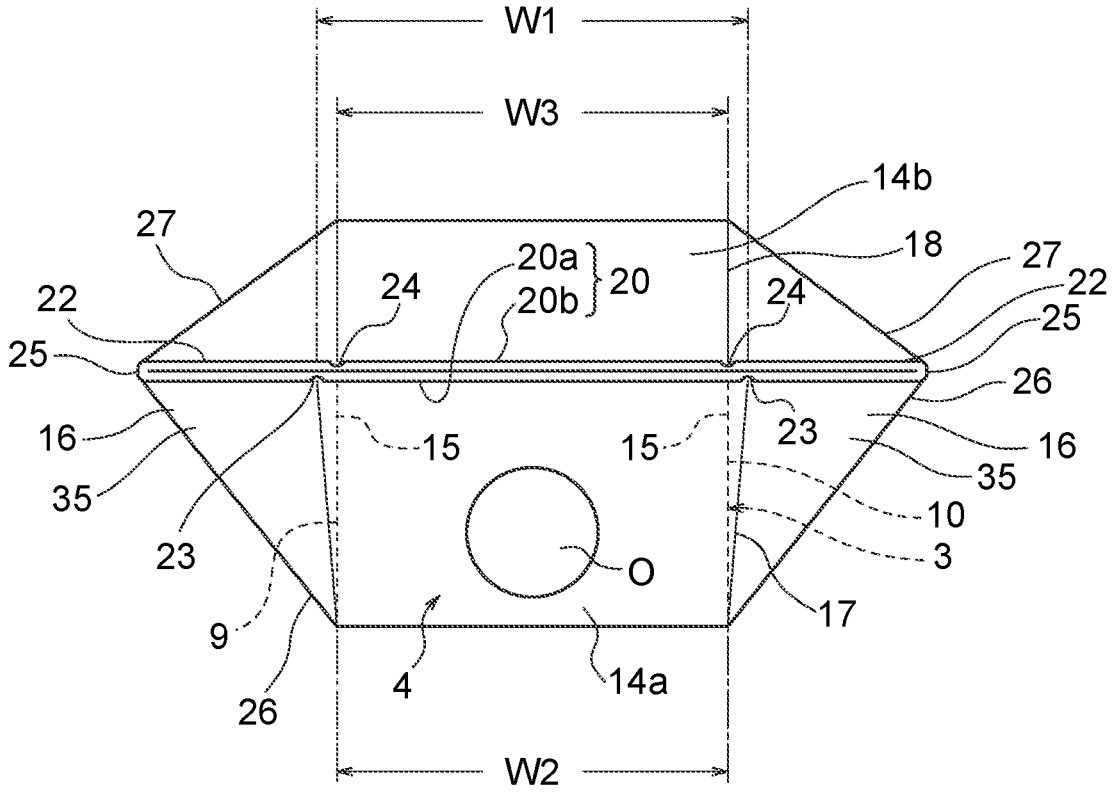
FIG. 3 is a plan view for illustrating a top portion obtained by bonding together top sealing panels of the paper container of the first example.
Figure 4:
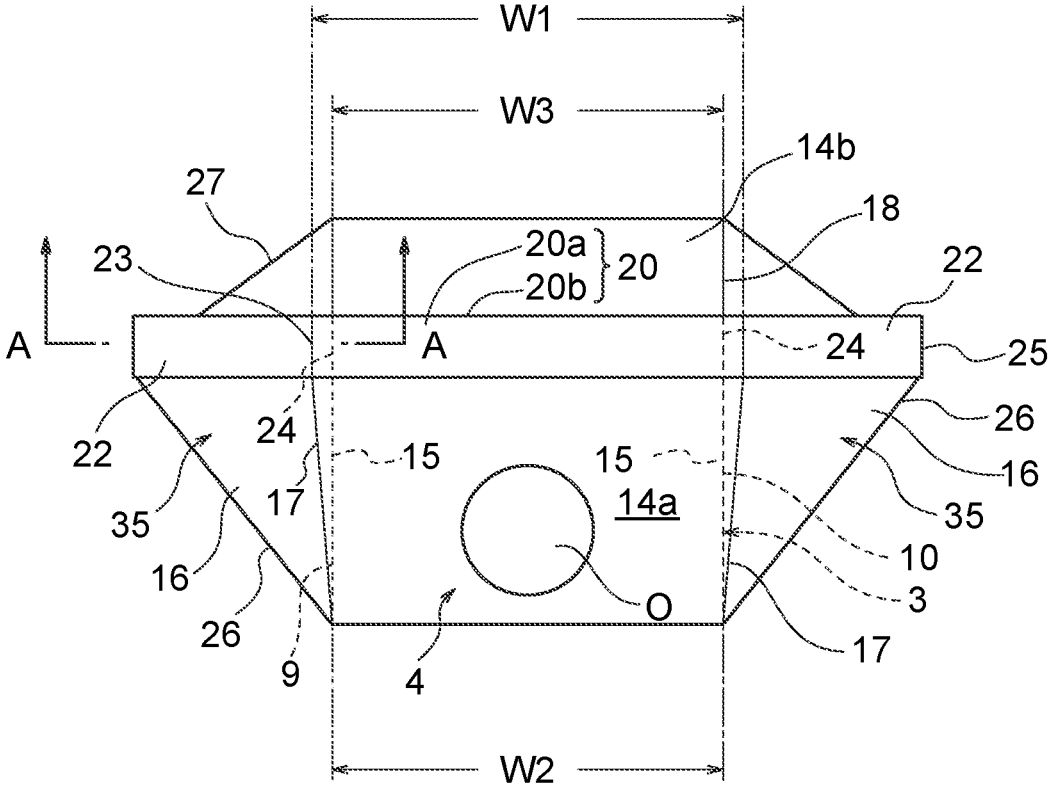
FIG. 4 is a plan view for illustrating a state in which the top sealing panels are folded down from the state illustrated in FIG. 3.
Figure 5:
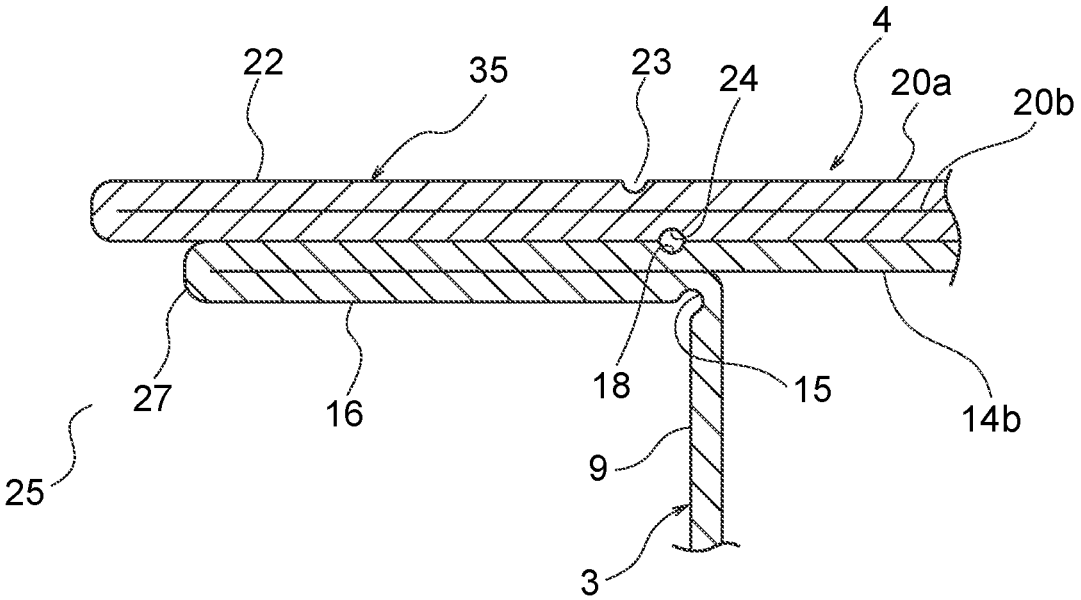
FIG. 5 is a partially omitted enlarged end surface view taken along the line A-A of FIG. 4.
Figure 6:
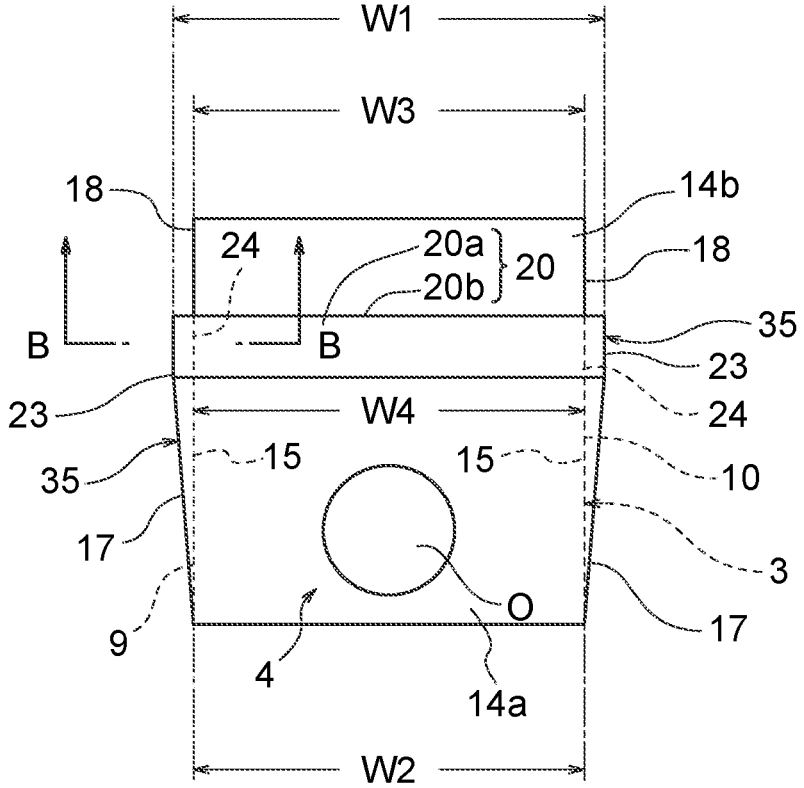
FIG. 6 is a plan view for illustrating a state in which flaps are folded down on side surfaces of the paper container from the state illustrated in FIG. 4.
Figure 7:
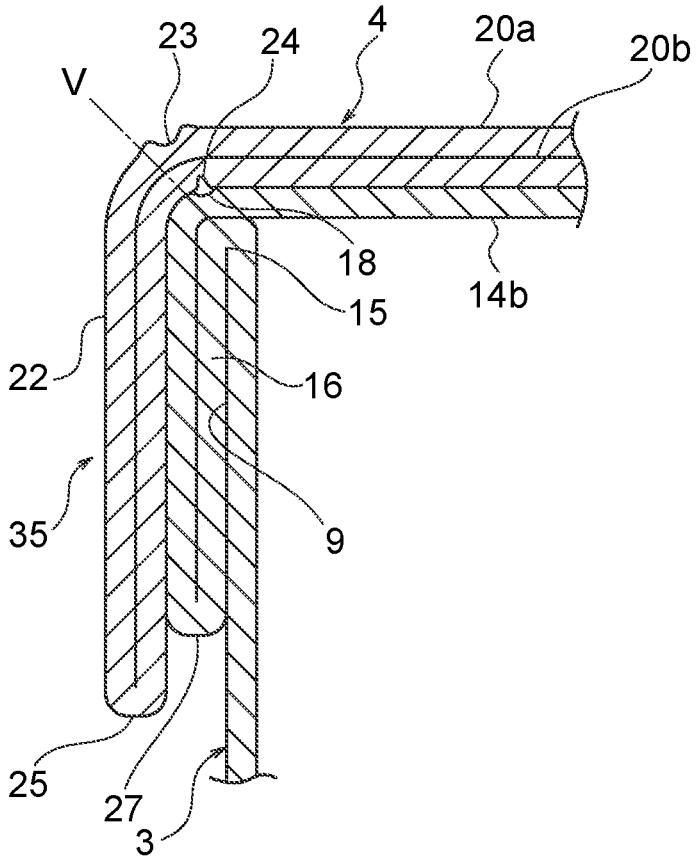
FIG. 7 is a partially omitted enlarged end surface view taken along the line B-B of FIG. 6.

FIG. 1 to FIG. 7 are illustrations of a first example of a paper container according to an embodiment of the present invention. FIG. 1 is a perspective view for illustrating the first example of the paper container according to the embodiment of the present invention. FIG. 2 is a developed view for illustrating the paper container of the first example. FIG. 3 is a plan view for illustrating a top portion obtained by bonding together top sealing panels of the paper container of the first example. FIG. 4 is a plan view for illustrating a state in which the top sealing panels are folded down from the state illustrated in FIG. 3. FIG. 5 is a partially omitted enlarged end surface view taken along the line A-A of FIG. 4. FIG. 6 is a plan view for illustrating a state in which flaps are folded down on side surfaces of the paper container from the state illustrated in FIG. 4. FIG. 7 is a partially omitted enlarged end surface view taken along the line B-B of FIG. 6.

Further, herein, in the following description, a direction from a top portion side to a bottom portion side of the paper container is defined as an up-and-down direction. A direction from a left side surface side to a right side surface side of the paper container is defined as a right-and-left direction. A direction from a front side to a back side of the paper container is defined as a front-and-rear direction.

Further, herein, a width of a tubular body in the right-and-left direction refers to a width of an upper end portion of the tubular body in the right-and-left direction at a position at which the tubular body is aligned with the top sealing panels in the up-and-down direction at the time of assembly of the paper container.

A paper container 1 of the first example is a flat top-type paper container as illustrated in FIG. 1.

The paper container 1 is formed of a single carton blank 2 illustrated in FIG. 2 having a thermoplastic resin laminated on each of a front surface and a back surface thereof. The paper container 1 includes a quadrangular tubular body 3, a top portion 4 forming a flat surface, and a bottom portion 5. Further, the paper container 1 of the first example includes a spout 6 as liquid pouring means. However, the liquid pouring means is not limited to the spout, and may be, for example, a straw hole formed in the top portion 4. Further, the top portion 4 of the paper container 1 of the first example forms an inclined surface which is lower on a front side and higher on a back side thereof. However, the top portion may form a horizontal surface.

The carton blank 2 includes a body front panel 8, a body left side panel 9, a body right side panel 10, a body back panel 11, and a vertical direction sealing panel 12. The body front panel 8, the body left side panel 9, the body right side panel 10, and the body back panel 11 are contiguous with each other through body vertical folding lines 7. The vertical direction sealing panel 12 is contiguous with the body left side panel 9, and is configured to form the quadrangular tubular body 3 at the time of assembly of the paper container 1 to be described later. The body front panel 8 and the body back panel 11 have the same width in the right-and-left direction and the body left side panel 9 and the body right side panel 10 have the same width in the front-and-rear direction so that the tubular body 3 has a rectangular or square cross section. Further, the top portion 4 of the paper container of the first example forms the inclined surface, and hence second top portion horizontal folding lines 15 each have an inclination lower on the body front panel 8 side and higher on the body back panel 11 side in accordance with an inclination of the top portion 4.

A pair of top panels 14 are contiguous with an upper end of the body front panel 8 and an upper end of the body back panel 11 through first top portion horizontal folding lines 13 so as to be opposed to each other at the time of assembly of the tubular body 3 of the paper container 1 to be described later. A pair of side panels 16 are contiguous with an upper end of the body left side panel 9 and an upper end of the body right side panel 10 through second top portion horizontal folding lines 15 so as to be opposed to each other at the time of assembly of the tubular body 3 of the paper container 1 to be described later. The top panels 14 and the side panels 16 are contiguous with each other through front-side top panel vertical folding lines 17 and back-side top panel vertical folding lines 18.

A front-side top panel 14*a* of the top panels 14 on a front side has an opening O in which the spout is to be provided. In order to keep a gas barrier property of the paper container 1, the opening O may be formed by half-cutting the carton blank 2, or may be covered with an aluminum film or a film having a high gas barrier property.

As illustrated in FIG. 2, the front-side top panel vertical folding lines 17 of the first example extend obliquely so as to gradually increase an interval between the front-side top panel vertical folding lines 17 from the body front panel 8 side toward a first top sealing panel to be described later, and are formed so as to join with front-side top sealing vertical folding lines to be described later, respectively. An inclination of each of the front-side top panel vertical folding lines 17 is not particularly limited. However, in order to effectively prevent warp of a flap of the paper container to be described later, it is preferred that an inclination angle of the front-side top panel vertical folding line 17 be equal to or larger than 1° with respect to an up-and-down direction of the carton blank 2. When the inclination angle is equal to or larger than 1°, even in a case of a small-sized paper container having a volume of about 200 cc, a width of a front-side top sealing panel in the right-and-left direction to be described later can be larger than a width of the tubular body or a width of a back-side top sealing panel in the right-and-left direction by a sufficient dimension, thereby being capable of reliably obtaining the effects of the present invention. Further, it is preferred that the inclination angle of the front-side top panel vertical folding line 17 be equal to or smaller than 5°. When the inclination angle exceeds 5°, it may be difficult to assemble the paper container depending on a size of the paper container.

Meanwhile, the back-side top panel vertical folding lines 18 of the first example extend in parallel to the up-and-down direction of the carton blank 2 without inclining, and are formed so as to join with back-side top sealing vertical folding lines 24 to be described later, respectively.

A pair of first top sealing panels 20 are contiguous with upper ends of the pair of top panels 14 through top sealing horizontal folding lines 19 so as to be opposed to each other at the time of assembly of the tubular body 3 of the paper container to be described later. Second top sealing panels 22 are contiguous with upper ends of the pair of side panels 16 through top sealing horizontal folding lines 21 so as to be opposed to each other at the time of assembly of the tubular body 3 of the paper container 1 to be described later. The first top sealing panels 20 and the second top sealing panels 22 are contiguous with each other through front-side top sealing vertical folding lines 23, which respectively join with the front-side top panel vertical folding lines 17, and through the back-side top sealing vertical folding lines 24, which respectively join with the back-side top panel vertical folding lines 18. Further, a side top sealing vertical folding line 25 is formed in each of the second top sealing panels 22 so as to extend from an upper end of the second top sealing panel 22 to the top sealing horizontal folding line 21.

In the first example, a front-side top sealing panel 20*a* of the first top sealing panels 20, which is arranged on the front side therebetween, is formed so as to have a width W1 in the right-and-left direction larger than a width W2 of the body front panel 8 in the right-and-left direction and a width W3 of a back-side top sealing panel 20*b* of the first top sealing panels 20 in the right-and-left direction, which is arranged on the back side therebetween.

Further, the back-side top sealing panel 20*b* is formed so as to have the width W3 in the right-and-left direction equal to the width W2 of the body front panel 8.

The width W3 of the back-side top sealing panel 20*b* is not particularly limited as long as the width W3 of the back-side top sealing panel 20*b* is smaller than the width W1 of the front-side top sealing panel 20*a*.

A difference D1 between the width W1 of the front-side top sealing panel 20*a* and the width W2 of the body front panel 8 is not particularly limited. However, as described later, in the first example in which the width W2 of the body front panel 8 is equal to a width of the tubular body 3 in the right-and-left direction, it is preferred that the difference D1 be equal to or larger than an amount twice as large as a thickness of the carton blank 2. With this configuration, at the time of assembly of the paper container 1 to be described later, each of the front-side top sealing vertical folding lines 23 can be located more on an outer side in the right-and-left direction than an outer surface of the left side panel 9 or the right side panel 10 of the tubular body 3 by an amount equal to or larger than the thickness of the carton blank 2.

Further, it is preferred that the difference D1 be equal to or smaller than an amount six times as large as the thickness of the carton blank 2. At the time of assembly of the paper container 1 to be described later, between the front-side top sealing panel 20*a* and the body left side panel 9 or the body right side panel 10, there are sandwiched the back-side top sealing panel 20*b* and the side panel 16 folded in two layers, which have a total thickness three times as large as the thickness of the carton blank 2. Accordingly, when the difference D1 is set to exceed the amount six times as large as the thickness of the carton blank 2, it may be difficult to assemble the paper container.

Further, thermal welding is performed on portions of the paper container of this type by heating and pressing. Thus, in view of compression at the time of thermal welding of the carton blank, it is more preferred that the difference D1 be equal to or larger than an amount twice as large as the thickness of the carton blank 2 and equal to or smaller than an amount four times as large as the thickness of the carton blank 2.

In the first example, the difference D1 is set to an amount twice as large as the thickness of the carton blank 2.

Further, in the paper container of the first example, the top portion 4 forms the inclined surface. Thus, as illustrated in FIG. 2, the front-side top panel vertical folding lines 17 are longer than the back-side top panel vertical folding lines 18. Accordingly, even when the front-side top panel vertical folding lines 17 described above each have a small inclination, the width W1 of the front-side top sealing panel 20*a*, which is formed between the front-side top sealing vertical folding lines 23 continuous with the front-side top panel vertical folding lines 17, can be larger than the width W2 of the body front panel 8 by a sufficient dimension.

Further, the pair of side panels 16 each have a first side panel folding line 26 and a second side panel folding line 27. The first side panel folding line 26 extends from an intersection P1 of the body vertical folding line 7 and a front-side end portion of the second top portion horizontal folding line 15 to an intersection P2 of the top sealing horizontal folding line 21 and the side top sealing vertical folding line 25. The second side panel folding line 27 extends from an intersection P3 of the body vertical folding line 7 and a back-side end portion of the second top portion horizontal folding line 15 to the intersection P2.

Further, a pair of outer bottom panels 29 are contiguous with a lower end of the body front panel 8 and a lower end of the body back panel 11 so as to be opposed to the body front panel 8 and the body back panel 11 through bottom horizontal folding lines 28, respectively. A pair of inner bottom panels 31 are contiguous with a lower end of the body left side panel 9 and a lower end of the body right side panel 10 so as to be opposed to the body left side panel 9 and the body right side panel 10 through bottom horizontal folding lines 30, respectively.

Further, bottom sealing panels 33 are formed so as to be contiguous with the pair of outer bottom panels 29 and the pair of inner bottom panels 31 through bottom sealing horizontal folding lines 32. The configuration for forming the bottom portion 5 is not limited thereto. A publicly-known configuration of the bottom portion of the paper container can be used.

For assembly of the paper container 1 from the carton blank 2 formed as described above, first, the carton blank is folded along the body vertical folding lines 7, and an opening edge 34 of the carton blank 2 in a width direction thereof is bonded to the vertical direction sealing panel 12, thereby forming the quadrangular tubular body 3. Then, the bottom sealing panels 33 are bonded together to seal an opening of the bottom portion of the tubular body 3. The carton blank is folded along the bottom horizontal folding lines 28 and 30, and the outer bottom panels 29 and the inner bottom panels 31 are folded and bonded together, thereby forming the bottom portion 5.

When the bottom portion 5 is formed, a liquid is filled into the paper container 1 through an upper opening of the tubular body 3.

When the liquid is filled in, first, as illustrated in FIG. 3, the second top sealing panels 22 are folded along the side top sealing vertical folding lines 25. Opposing surfaces of the first top sealing panels 20 are bonded together, and opposing surfaces of the second top sealing panels 22 are bonded together. The carton blank is folded along the first side panel folding lines 26 and the second side panel folding lines 27, thereby forming the top portion 4 having a flat surface, and forming flaps 35 each having a triangular shape. Then, as illustrated in FIG. 4, the bonded top seal panels are folded down to the back side.

At this time, as illustrated in FIG. 5, the width W1 of the front-side top sealing panel 20*a* is larger than the width W2 of the body front panel 8. Accordingly, the width W1 of the front-side top sealing panel 20*a* is larger than a width W4 of the tubular body 3 in the right-and-left direction that is equal to the width W2 of the body front panel 8. Further, each of the left and right front-side top sealing vertical folding lines 23 is located more on the outer side in the right-and-left direction than the outer surface of the left side panel 9 or the right side panel 10 of the tubular body 3. Further, in the first example, the difference D1 is set to an amount twice as large as the thickness of the carton blank 2. Accordingly, a positional displacement amount of the front-side top sealing vertical folding line 23 from the outer surface of the left side panel 9 or the right side panel 10 of the tubular body 3 corresponds to an amount equal to the thickness of the carton blank 2. When the positional displacement amount of the front-side top sealing vertical folding line 23 from the outer surface of the left side panel 9 or the right side panel 10 of the tubular body 3 is equal to or larger than the thickness of the carton blank 2, at the time of folding down of the flap to be described later, a position of the front-side top sealing vertical folding line 23 can be closer to an apex of a folding-down corner portion of the flap, and hence the flap can easily be folded down, which is preferred. Further, it is preferred that the positional displacement amount of the front-side top sealing vertical folding line 23 from the outer surface of the left side panel 9 or the right side panel 10 of the tubular body 3 be equal to or smaller than an amount three times as large as the thickness of the carton blank 2. When the positional displacement amount exceeds an amount three times as large as the thickness of the carton blank 2, at the time of folding down of the flap to be described later, the position of the front-side top sealing vertical folding line 23 is beyond the apex of the folding-down corner portion of the flap, and deformation of the paper container is increased. Thus, it may be difficult to assemble the paper container.

Further, in the first example, the front-side top panel vertical folding lines 17 extend obliquely so as to gradually increase the interval between the front-side top panel vertical folding lines 17 from the body front panel side toward the first top sealing panel 20. Accordingly, a position of each of the front-side top panel vertical folding lines 17 is gradually shifted more on the outer side in the right-and-left direction than the outer surface of the left side panel 9 or the right side panel 10 of the tubular body 3 as each of the front-side top panel vertical folding lines 17 extends toward the first top sealing panel 20.

Under this state, as illustrated in FIG. 6, the carton blank is mountain-folded along the front-side top panel vertical folding lines 17, the back-side top panel vertical folding lines 18, and the front-side top sealing vertical folding lines 23, and the carton blank is valley-folded along the second top portion horizontal folding lines 15 and the back-side top sealing vertical folding lines 24. Thus, the flaps 35 are folded down onto right and left side surfaces of the tubular body 3.

At this time, each flap 35 is formed of a laminate including the second top sealing panel 22 folded in layers and the side panel 16 folded in layers, and has a thickness four times as large as the thickness of the carton blank 2. Thus, a strong repulsive force is generated in the top portion 4 and against folding down of the flap 35. Further, as illustrated in FIG. 7, the apex of the folding-down corner portion of the flap is located more on the outer side in the right-and-left direction as a layer of the flap is located more on the outer surface side of the flap as indicated by an imaginary line V.

Accordingly, if the front-side top sealing vertical folding line 23 and the outer surface of the left side panel 9 or the right side panel 10 of the tubular body are aligned with each other in the right-and-left direction as in the related-art paper container, when the flap is folded down, the front-side top sealing vertical folding line 23 is located more on an inner side in the right-and-left direction than the apex of the folding-down corner portion of the flap. Thus, the flap 35 cannot easily be folded down, and the repulsive force against folding down of the flap is increased.

In contrast, in the paper container 1 of the first example, the front-side top sealing vertical folding line 23 is located more on the outer side in the right-and-left direction than the outer surface of the left side panel 9 or the right side panel 10 of the tubular body by an amount equal to the thickness of the carton blank 2. Accordingly, the position of the front-side top sealing vertical folding line 23 is closer to the apex of the folding-down corner portion of the flap 35. Thus, the flap 35 can easily be folded down, thereby being capable of reducing the repulsive force generated in the top portion 4 and against folding down of the flap 35.

Further, in the first example, as extending toward the first top sealing panel 20, each of the front-side top panel vertical folding lines 17 becomes gradually closer to the apex of the folding-down corner portion of the flap 35, which is located more on the outer side in the right-and-left direction than the outer surface of the left side panel 9 or the right side panel 10 of the tubular body 3. Accordingly, the flap 35 can more easily be folded down, thereby being capable of further reducing the repulsive force against folding down of the flap 35.

Then, the folded-down flap 35 is thermally welded and bonded to the left side panel 9 or the right side panel 10. After the top portion 4 of the paper container 1 is thus formed, the spout 6 is fitted into the opening O. Thus, the paper container 1 is assembled. The spout 6 may be fitted into the opening O before the top portion 4 is formed.

According to the paper container 1 of the first example configured as described above, the width W1 of the front-side top sealing panel 20*a* is larger than the width W2 of the tubular body 3. Accordingly, a position of each of the front-side top sealing vertical folding lines 23 can be close to the apex of the folding-down corner portion of the flap 35, which is located more on the outer side in the right-and-left direction than the outer surface of the left side panel 9 or the right side panel 10 of the tubular body 3. Thus, the flap can easily be folded down, thereby being capable of reducing the repulsive force against folding down of the flap.

Further, the width W1 of the front-side top sealing panel 20*a* is larger than the width W3 of the back-side top sealing panel 20*b*. Accordingly, the position of each of the front-side top sealing vertical folding lines 23 can be close to the apex of the folding-down corner portion of the flap 35, which is located more on the outer side in the right-and-left direction than a position of each of the back-side top sealing vertical folding lines 24. Thus, the flap 35 can easily be folded down, thereby being capable of reducing the repulsive force against folding down of the flap 35.

Further, the front-side top panel vertical folding lines 17 extend obliquely so as to gradually increase the interval between the front-side top panel vertical folding lines 17 from the front side toward the first top sealing panel 20, and join with the front-side top sealing vertical folding lines 23, respectively. Accordingly, the paper container 1 can easily be formed, which includes the front-side top sealing panel 20*a* having the width in the right-and-left direction larger than the width of the back-side top sealing panel 20*b*.

Further, the position of each of the front-side top panel vertical folding lines 17 can be close to the apex of the folding-down corner portion of the flap 35, which is located more on the outer side in the right-and-left direction than the outer surface of the left side panel 9 or the right side panel 10 of the tubular body 3. Thus, the flap 35 can easily be folded down, thereby being capable of reducing the repulsive force against folding down of the flap 35.

Figure 8:
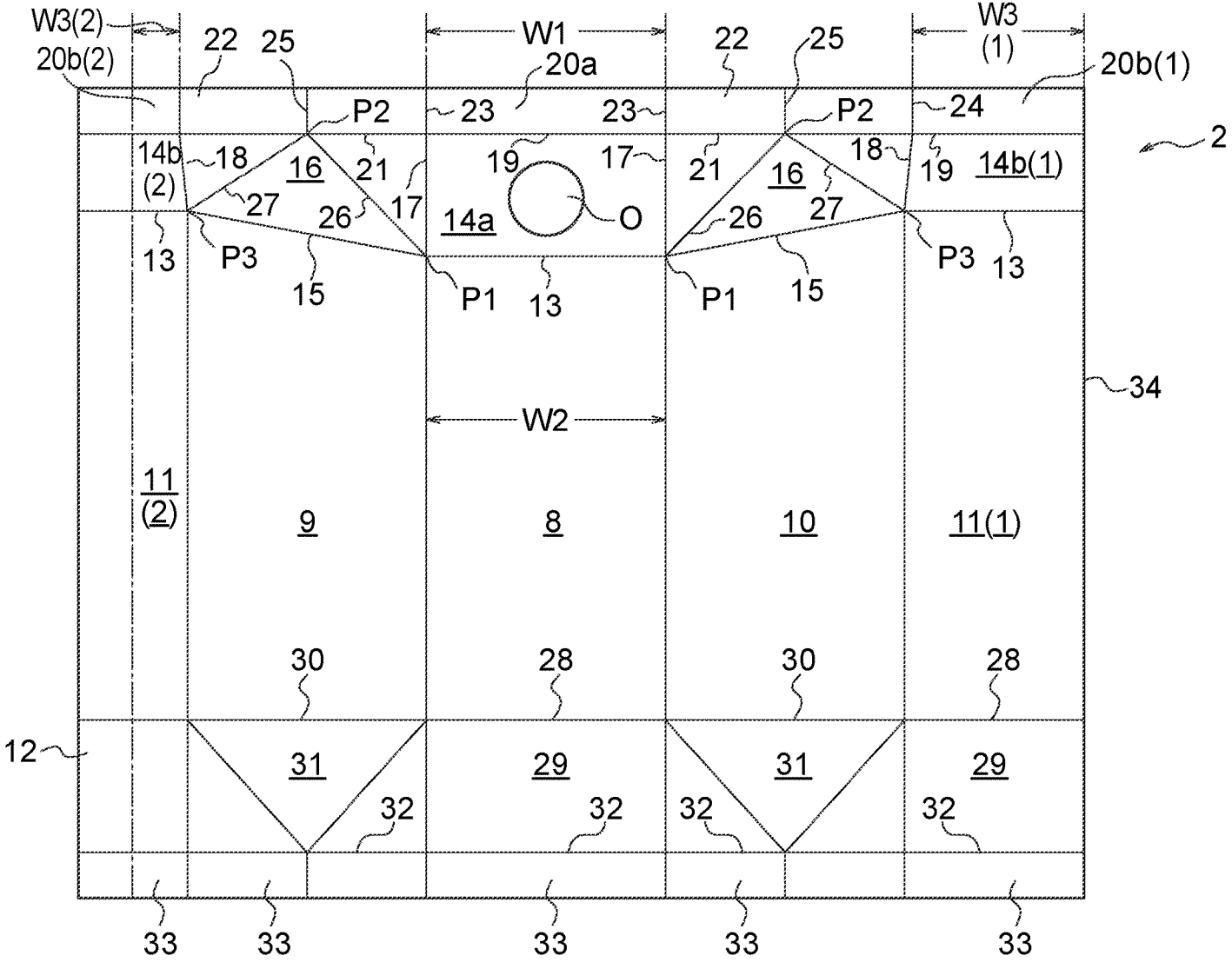
FIG. 8 is a developed view for illustrating a second example of the paper container according to the embodiment of the present invention.
Figure 9:
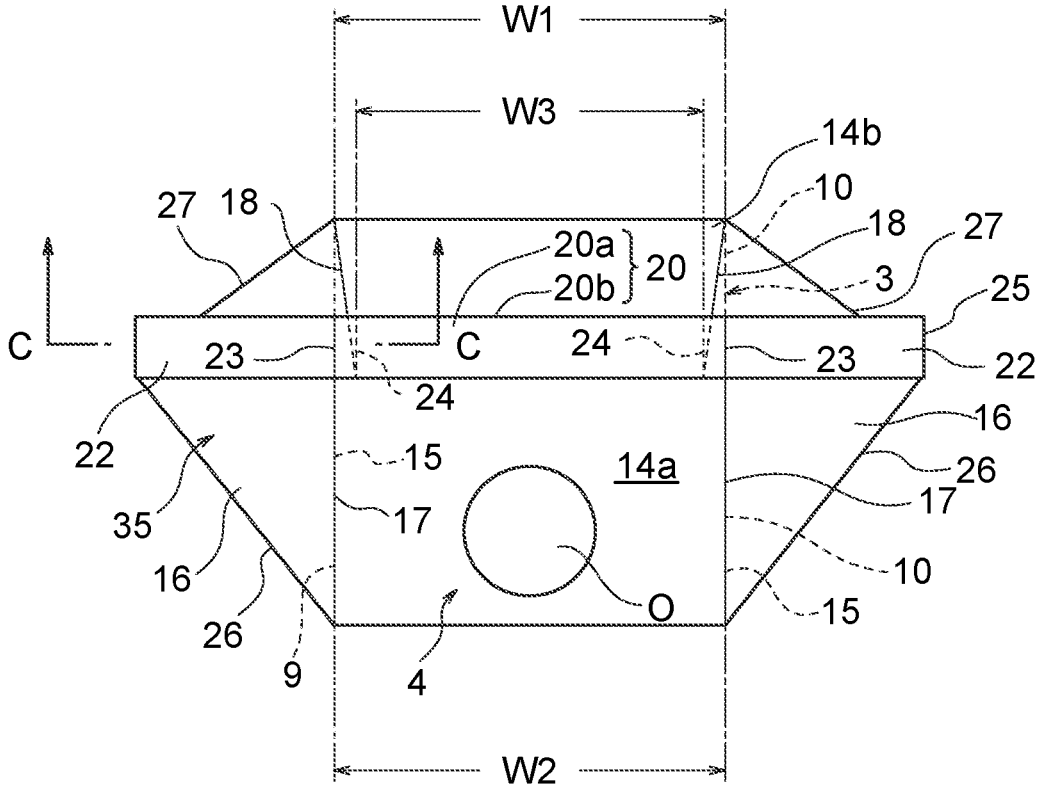
FIG. 9 is a plan view for illustrating a state in which the top sealing panels of the paper container of the second example are folded down.
Figure 10:
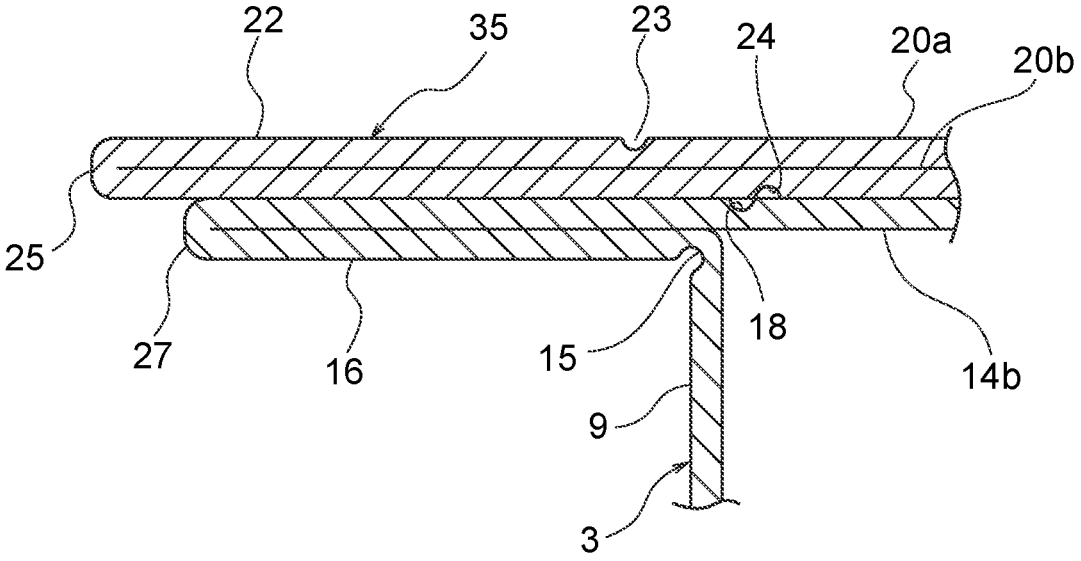
FIG. 10 is a partially omitted enlarged end surface view taken along the line C-C of FIG. 9.
Figure 11:
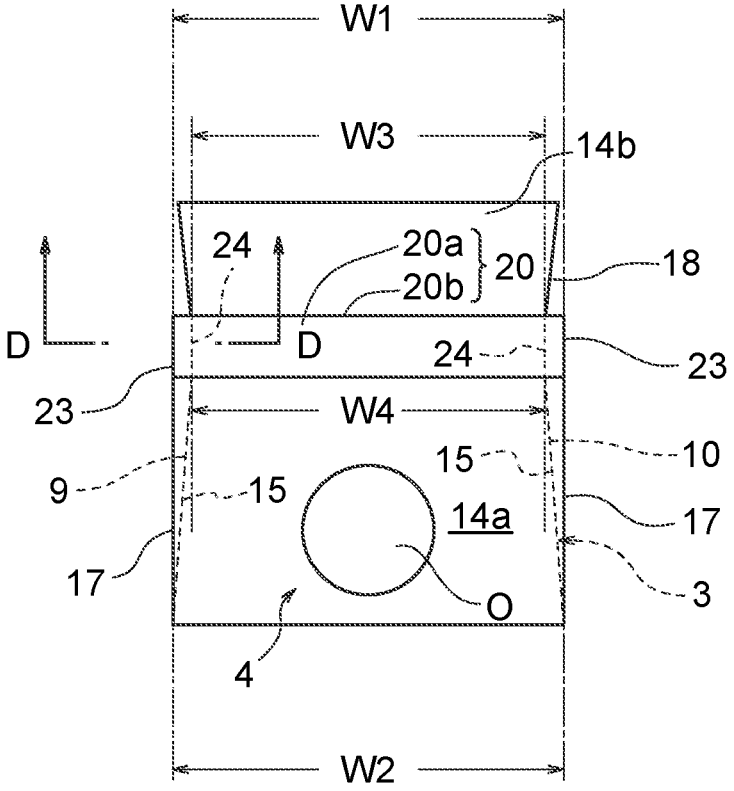
FIG. 11 is a plan view for illustrating a state in which the flaps are folded down on the side surfaces from the state illustrated in FIG. 9.
Figure 12:
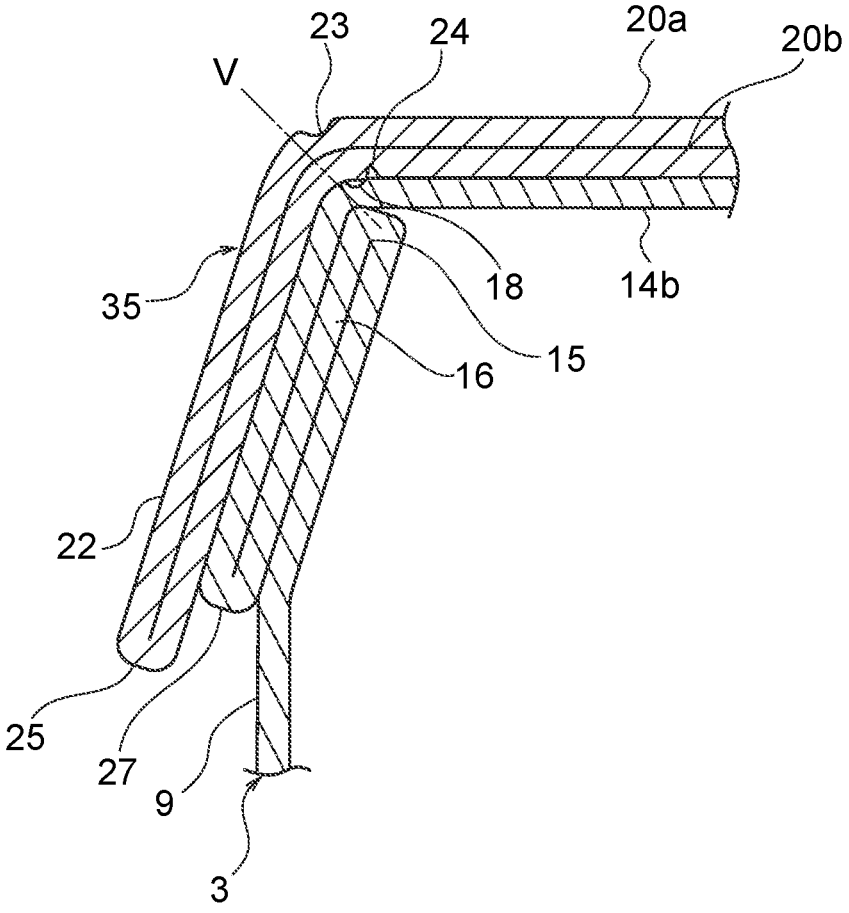
FIG. 12 is a partially omitted enlarged end surface view taken along the line D-D of FIG. 11.

FIG. 8 to FIG. 12 are illustrations of a second example of the paper container according to the embodiment of the present invention. FIG. 8 is a developed view for illustrating the second example of the paper container according to the embodiment of the present invention. FIG. 9 is a plan view for illustrating a state in which the top sealing panels of the paper container of the second example are folded down. FIG. 10 is a partially omitted enlarged end surface view taken along the line C-C of FIG. 9. FIG. 11 is a plan view for illustrating a state in which the flaps are folded down on the side surfaces from the state illustrated in FIG. 9. FIG. 12 is a partially omitted enlarged end surface view taken along the line D-D of FIG. 11.

The same configurations of the paper container of the second example as those of the first example are denoted by the same reference symbols, and the description thereof is omitted. Only configurations different from those of the first example are described.

The paper container of the second example is different from the paper container of the first example in configurations of the front-side top panel vertical folding lines 17, the back-side top panel vertical folding lines 18, and the first top sealing panels 20.

In the carton blank 2 of the second example, as illustrated in FIG. 8, the front-side top panel vertical folding lines 17 extend in parallel to the up-and-down direction of the carton blank 2 without inclining, and are formed so as to join with the front-side top sealing vertical folding lines 23, respectively.

Further, in the second example, the back-side top panel vertical folding lines 18 extend obliquely so as to gradually decrease an interval between the back-side top panel vertical folding lines 18 from the body back panel 11 side toward the first top sealing panel 20, and are formed so as to join with the back-side top sealing vertical folding lines 24, respectively.

An inclination angle of each of the back-side top panel vertical folding lines 18 is not particularly limited. However, in order to effectively prevent warp of the flap of the paper container, it is preferred that the inclination angle of the back-side top panel vertical folding line 18 be equal to or larger than 1° with respect to the up-and-down direction of the carton blank 2. Further, it is preferred that the inclination angle of the back-side top panel vertical folding line 18 be equal to or smaller than 5°. When the inclination angle of the back-side top panel vertical folding line 18 exceeds 5°, it may be difficult to assemble the paper container 1 of the second example to be described later.

The width W1 of the front-side top sealing panel 20*a* in the right-and-left direction is equal to the width W2 of the body front panel 8, and larger than the width W3 of the back-side top sealing panel 20*b*.

The width W3 of the back-side top sealing panel 20*b* is smaller than the width W2 of the body front panel 8.

It is preferred that a difference D2 between the width W1 of the front-side top sealing panel 20*a* in the right-and-left direction and the width W3 of the back-side top sealing panel 20*b* be equal to or larger than an amount twice as large as the thickness of the carton blank 2 and equal to or smaller than an amount six times as large as the thickness of the carton blank 2. In the second example, the difference D2 is set to an amount twice as large as the thickness of the carton blank 2.

The other configurations are the same as those of the first example. Accordingly, description thereof is also applied to description of the second example, and redundant description is omitted.

For assembly of the paper container 1 from the carton blank 2 formed as described above, first, the carton blank is folded along the body vertical folding lines 7, and the opening edge 34 of the carton blank 2 in the width direction thereof is bonded to the vertical direction sealing panel 12, thereby forming the quadrangular tubular body 3. Then, the bottom sealing panels 33 are bonded together to seal the opening of the bottom portion of the tubular body 3. The carton blank is folded along the bottom horizontal folding lines 28 and 30, and the outer bottom panels 29 and the inner bottom panels 31 are folded and bonded together, thereby forming the bottom portion 5.

When the bottom portion 5 is formed, a liquid is filled into the paper container 1 through the upper opening of the tubular body 3.

When the liquid is filled in, as illustrated in FIG. 9, the second top sealing panels 22 are folded along the side top sealing vertical folding lines 25. The opposing surfaces of the first top sealing panels 20 are bonded together, and the opposing surfaces of the second top sealing panels 22 are bonded together. The carton blank is folded along the first side panel folding lines 26 and the second side panel folding lines 27, thereby forming the top portion 4 having a flat surface, and forming the flaps 35 each having a triangular shape. Then, the bonded first top sealing panels 20 and the bonded second top sealing panels 22 are folded down to the back side.

At this time, as illustrated in FIG. 9, the width W3 of the back-side top sealing panel 20*b* is smaller than the width W2 of the body front panel 8. Accordingly, each of the left and right back-side top sealing vertical folding lines 24 is located more on an inner side in the right-and-left direction than the outer surface of the left side panel 9 or the right side panel 10 of the tubular body 3. Further, in the second example, the difference D2 is set to an amount twice as large as the thickness of the carton blank 2. Accordingly, a positional displacement amount of the back-side top sealing vertical folding line 24 from the outer surface of the left side panel 9 or the right side panel 10 of the tubular body 3 corresponds to an amount equal to the thickness of the carton blank 2. Further, in the second example, the back-side top panel vertical folding lines 18 extend obliquely so as to gradually decrease the interval between the back-side top panel vertical folding lines 18 from a back side toward the first top sealing panel 20. Accordingly, a position of each of the back-side top panel vertical folding lines 18 is gradually shifted more on the inner side in the right-and-left direction than the outer surface of the left side panel 9 or the right side panel 10 of the tubular body 3 as each of the back-side top panel vertical folding lines 18 extends toward the first top sealing panel 20.

Under this state, as illustrated in FIG. 11, the carton blank is mountain-folded along the front-side top panel vertical folding lines 17, the back-side top panel vertical folding lines 18, and the front-side top sealing vertical folding lines 23, and the carton blank is valley-folded along the second top portion horizontal folding lines 15 and the back-side top sealing vertical folding lines 24. Thus, the flaps 35 are folded down onto right and left side surfaces of the tubular body 3.

At this time, each of the back-side top sealing vertical folding lines 24 is located more on the inner side in the right-and-left direction than the outer surface of the left side panel 9 or the right side panel 10 of the tubular body 3. Accordingly, as illustrated in FIG. 12, at a position at which the top sealing panels 20 overlap each other, an upper end portion of the left side panel 9 or the right side panel 10 is pushed toward the inner side of the paper container 1 by the side panel 16 folded contiguously with a back-side top panel 14*b*, and by the second top sealing panel 22 folded contiguously with the back-side top sealing panel 20*b*. As a result, the width W4 of the tubular body 3 is substantially equal to the width W3 of the back-side top sealing panel 20*b*.

Thus, the width W1 of the front-side top sealing panel 20*a* is larger than the width W4 of the tubular body 3 by an amount twice as large as the thickness of the carton blank 2. Further, the position of each of the left and right front-side top sealing vertical folding line 23 can be more on the outer side in the right-and-left direction than the outer surface of the left side panel 9 or the right side panel 10 of the tubular body by an amount equal to the thickness of the carton blank 2.

With this configuration, the position of the front-side top sealing vertical folding line 23 can be close to the apex of the folding-down corner portion of the flap 35. Thus, the flap 35 can easily be folded down, thereby being capable of reducing the repulsive force against folding down of the flap 35.

According to the paper container 1 of the second example formed as described above, the width W3 of the back-side top sealing panel 20*b* is smaller than the width W2 of the body front panel 8. Accordingly, at the position at which the top sealing panels overlap each other when the flap 35 is folded down, the body left side panel 9 or the body right side panel 10 is pushed inward so that the width W4 of the tubular body 3 is reduced. Even when the width W1 of the front-side top sealing panel is set to the same dimension as the width W2 of the body front panel, the width W1 of the front-side top sealing panel can be larger than the width W3 of the back-side top sealing panel and the width W4 of the tubular body. Further, the position of each of the front-side top sealing vertical folding lines 23 can be close to the apex of the folding-down corner portion of the flap 35, which is located more on the outer side in the right-and-left direction than each of the back-side top sealing vertical folding lines 24 and the outer surface of the left side panel 9 or the right side panel 10 of the tubular body 3. Thus, the flap 35 can easily be folded down, thereby being capable of reducing the repulsive force against folding down of the flap 35.

Further, the left side panel 9 and the right side panel 10 of the tubular body 3 are pushed inward, thereby being capable of suppressing a bulge of the body of the paper container 1.

Further, in the second example, as each of the back-side top panel vertical folding lines 18 extends toward the first top sealing panel 20, the position of each of the back-side top panel vertical folding lines 18 is gradually shifted more on the inner side in the right-and-left direction than the outer surface of the left side panel 9 or the right side panel 10 of the tubular body 3, and each of the side panels pushes the left side panel 9 or the right side panel 10 of the tubular body 3 inward over a wide range. Therefore, the bulge of the body of the paper container 1 can more effectively be suppressed.

The other effects are the same as those given in the first example. Accordingly, description thereof is also applied to description of the second example, and redundant description is omitted.

Figure 13:
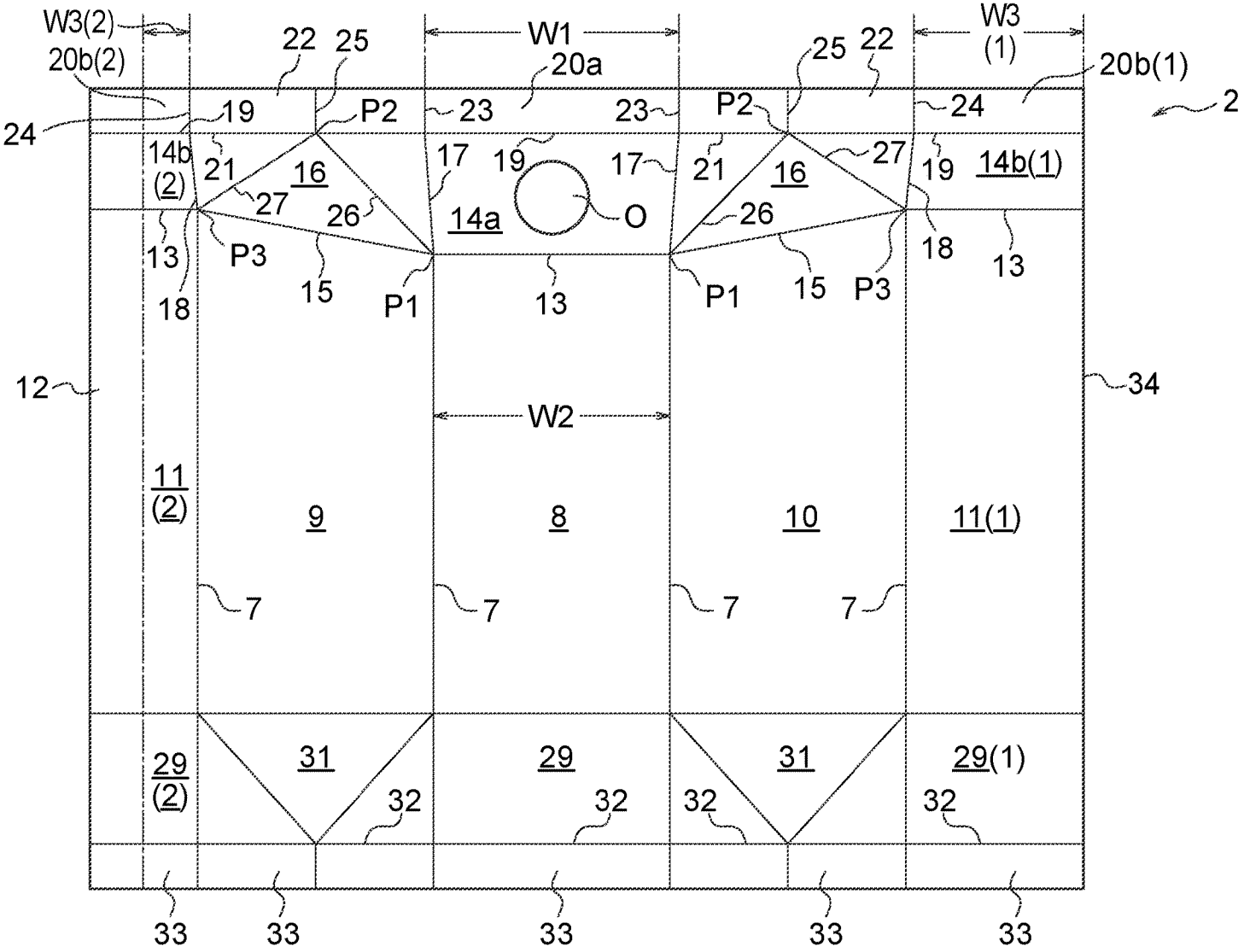
FIG. 13 is a developed view for illustrating a third example of the paper container according to the embodiment of the present invention.
Figure 14:
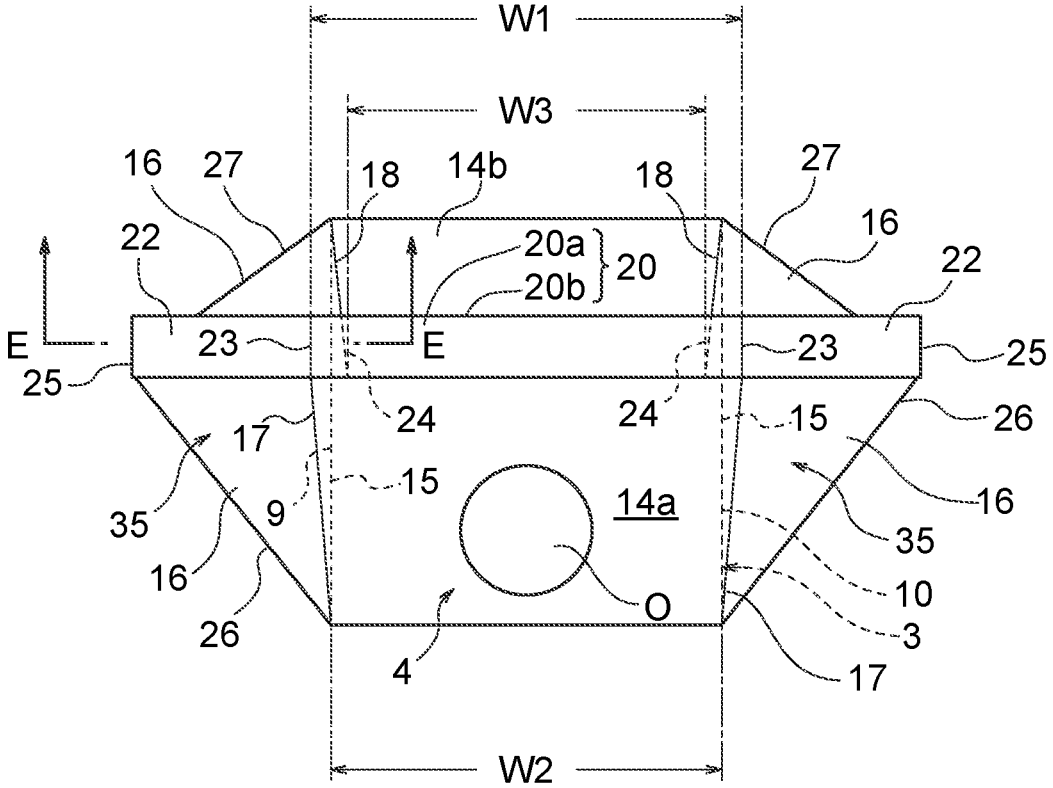
FIG. 14 is a plan view for illustrating a state in which the top sealing panels of the paper container of the third example are folded down.
Figure 15:
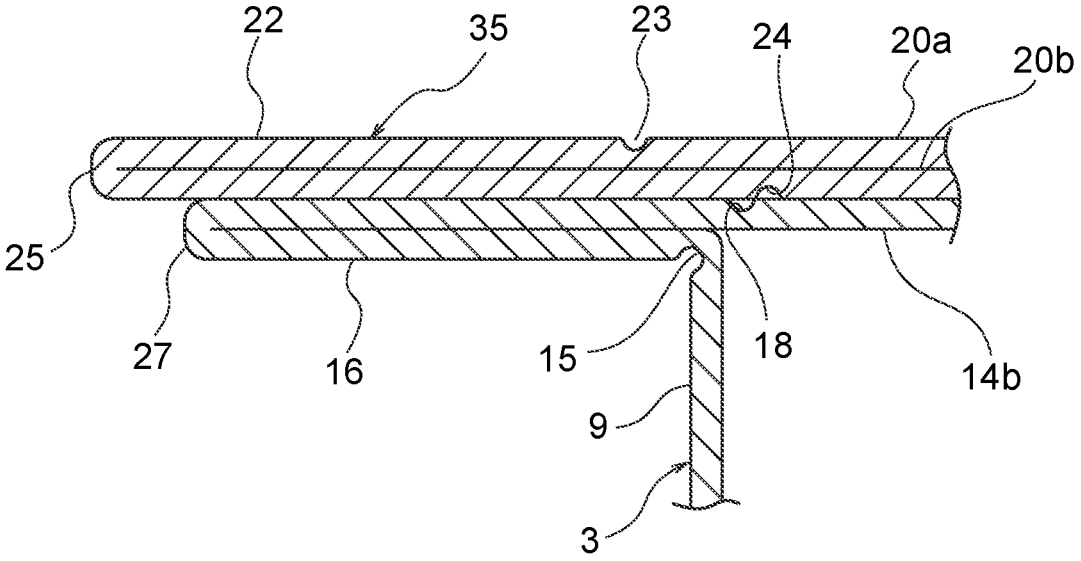
FIG. 15 is a partially omitted enlarged end surface view taken along the line E-E of FIG. 14.
Figure 16:
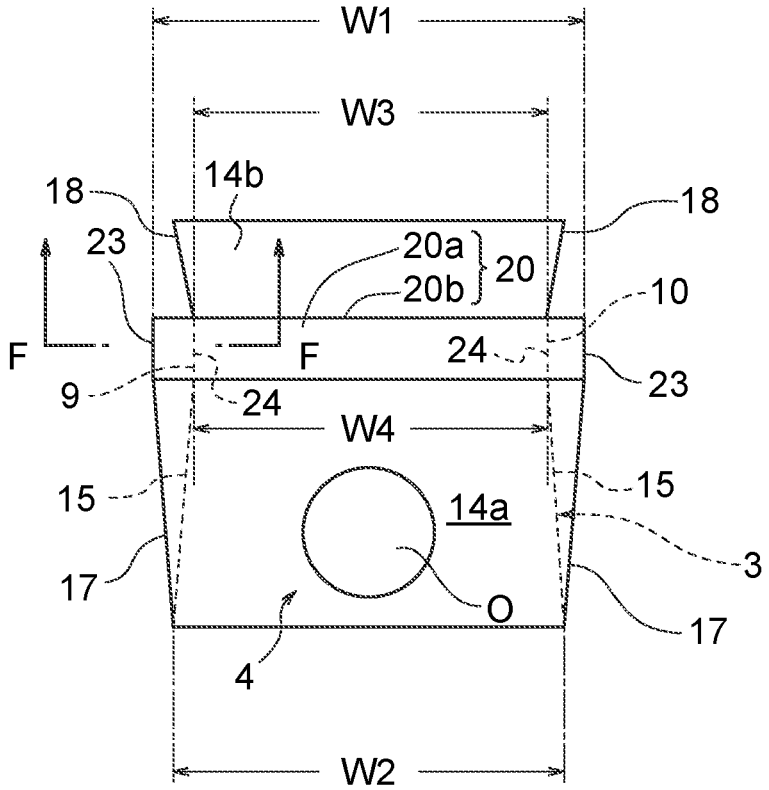
FIG. 16 is a plan view for illustrating a state in which the flaps are folded down on the side surfaces from the state illustrated in FIG. 14.
Figure 17:
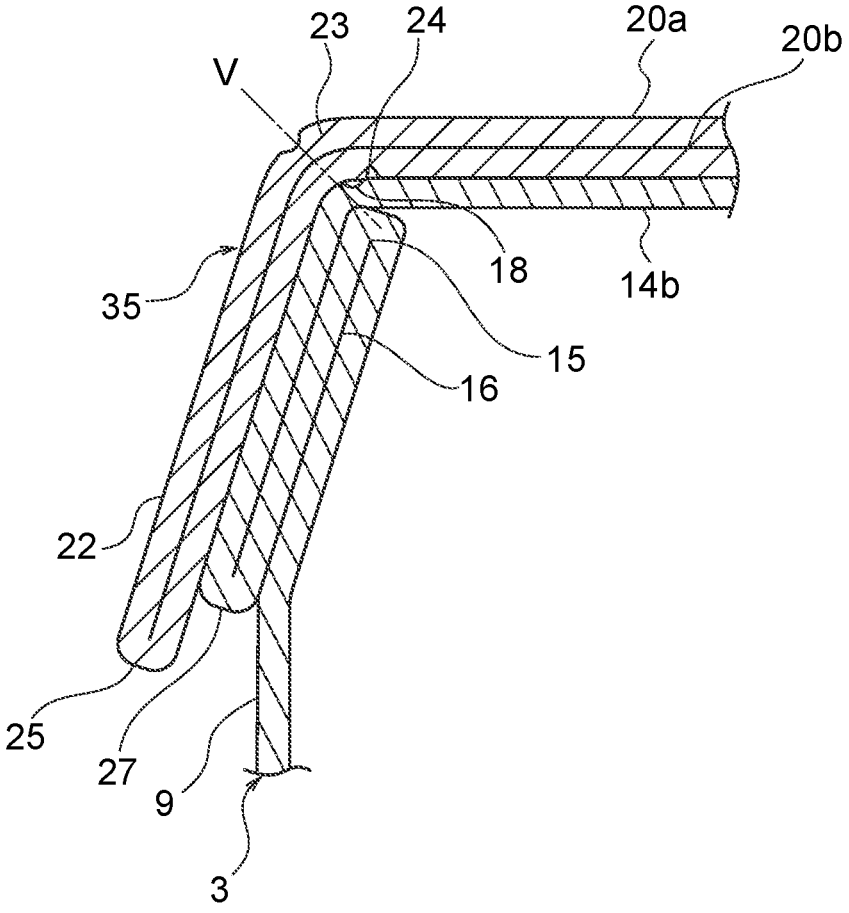
FIG. 17 is a partially omitted enlarged end surface view taken along the line F-F of FIG. 16.

FIG. 13 to FIG. 17 are illustrations of a third example of the paper container according to the embodiment of the present invention. FIG. 13 is a developed view for illustrating the third example of the paper container according to the embodiment of the present invention. FIG. 14 is a plan view for illustrating a state in which the top sealing panels of the paper container of the third example are folded down. FIG. 15 is a partially omitted enlarged end surface view taken along the line E-E of FIG. 14. FIG. 16 is a plan view for illustrating a state in which the flaps are folded down on the side surfaces from the state illustrated in FIG. 14. FIG. 17 is a partially omitted enlarged end surface view taken along the line F-F of FIG. 16.

The same configurations of the paper container of the third example as those of the first example are denoted by the same reference symbols, and the description thereof is omitted. Only configurations different from those of the first example are described.

The paper container of the third example is different from the paper container of the first example in configurations of the front-side top panel vertical folding lines 17, the back-side top panel vertical folding lines 18, the front-side top sealing panel 20*a*, and the back-side top sealing panel 20*b*.

In the carton blank 2 of the third example, as illustrated in FIG. 13, the front-side top panel vertical folding lines 17 extend obliquely so as to gradually increase the interval between the front-side top panel vertical folding lines 17 from the body front panel side toward the first top sealing panel 20, and are formed so as to join with the front-side top sealing vertical folding lines 23, respectively.

Further, the back-side top panel vertical folding lines 18 extend obliquely so as to gradually decrease the interval between the back-side top panel vertical folding lines 18 from the back side toward the first top sealing panel 20, and are formed so as to join with the back-side top sealing vertical folding lines 24, respectively.

An inclination of each of the front-side top panel vertical folding lines 17 and an inclination of each of the back-side top panel vertical folding lines 18 are not particularly limited. However, in order to effectively prevent warp of the flap of the paper container, it is preferred that a total of the inclination angles be equal to or larger than 1° with respect to the vertical direction of the carton blank 2. Further, it is preferred that the total of the inclination angles be equal to or smaller than 5°. When the total of the inclination angles exceeds 5°, it may be difficult to assemble the paper container 1 of the third example to be described later.

The width W1 of the front-side top sealing panel 20*a* in the right-and-left direction is larger than the width W2 of the body front panel 8 and the width W3 of the back-side top sealing panel 20*b*.

The width W3 of the back-side top sealing panel 20*b* is smaller than the width W2 of the body front panel 8.

It is preferred that a difference D3 between the width W1 of the front-side top sealing panel 20*a* and the width W2 of the body front panel 8 and a difference D4 between the width W3 of the back-side top sealing panel 20*b* and the width W2 of the body front panel 8 be equal to or larger than an amount twice as large as the thickness of the carton blank 2 and equal to or smaller than an amount six times as large as the thickness of the carton blank 2, which is obtained by adding the difference D2 to the difference D1. In the third example, the difference D3 and the difference D4 are set to an amount twice as large as the thickness of the carton blank 2.

The other configurations are the same as those of the first example. Accordingly, description thereof is also applied to description of the third example, and redundant description is omitted.

For assembly of the paper container 1 from the carton blank 2 formed as described above, first, the carton blank is folded along the body vertical folding lines 7, and the opening edge 34 of the carton blank 2 in the width direction thereof is bonded to the vertical direction sealing panel 12, thereby forming the quadrangular tubular body 3. Then, the bottom sealing panels 33 are bonded together to seal the opening of the bottom portion of the tubular body 3. The carton blank is folded along the bottom horizontal folding lines 28 and 30, and the outer bottom panels 29 and the inner bottom panels 31 are folded and bonded together, thereby forming the bottom portion 5.

When the bottom portion 5 is formed, a liquid is filled into the paper container 1 through the upper opening of the tubular body 3.

When the liquid is filled in, as illustrated in FIG. 14, the second top sealing panels are folded along the side top sealing vertical folding lines 25. The opposing surfaces of the first top sealing panels 20 are bonded together, and the opposing surfaces of the second top sealing panels 22 are bonded together. The carton blank is folded along the first side panel folding lines 26 and the second side panel folding lines 27, thereby forming the top portion 4 having a flat surface, and forming the flaps 35 each having a triangular shape. Then, the bonded top seal panels are folded down to the back side.

At this time, as illustrated in FIG. 15, the width W1 of the front-side top sealing panel 20*a* is larger than the width W2 of the body front panel 8 by an amount twice as large as the thickness of the carton blank 2. Accordingly, each of the left and right front-side top sealing vertical folding lines 23 is located more on the outer side in the right-and-left direction than the outer surface of the left side panel 9 or the right side panel 10 of the tubular body 3 by an amount equal to the thickness of the carton blank 2. Further, the width W3 of the back-side top sealing panel 20*b* is smaller than the width W2 of the body front panel 8 by an amount twice as large as the thickness of the carton blank 2. Accordingly, each of the left and right back-side top sealing vertical folding lines 24 is located more on the inner side in the right-and-left direction than the outer surface of the left side panel 9 or the right side panel 10 of the tubular body 3 by an amount equal to the thickness of the carton blank 2.

Further, in the third example, the back-side top panel vertical folding lines 18 extend obliquely so as to gradually decrease the interval between the back-side top panel vertical folding lines 18 from the back side toward the first top sealing panel 20. Accordingly, a position of each of the back-side top panel vertical folding lines 18 is gradually shifted more on the inner side in the right-and-left direction than the outer surface of the left side panel 9 or the right side panel 10 of the tubular body 3 as each of the back-side top panel vertical folding lines 18 extends toward the first top sealing panel 20.

Under this state, as illustrated in FIG. 16, the carton blank is mountain-folded along the front-side top panel vertical folding lines 17, the back-side top panel vertical folding lines 18, and the front-side top sealing vertical folding lines 23, and the carton blank is valley-folded along the second top portion horizontal folding lines 15 and the back-side top sealing vertical folding lines 24. Thus, the flaps 35 are folded down onto right and left side surfaces of the tubular body 3.

At this time, as illustrated in FIG. 17, each of the back-side top sealing vertical folding lines 24 is located more on the inner side in the right-and-left direction than the outer surface of the left side panel 9 or the right side panel 10 of the tubular body 3. Accordingly, as illustrated in FIG. 12, at a position at which the top sealing panels 20 overlap each other, the upper end portion of the left side panel 9 or the right side panel 10 is pushed toward the inner side of the paper container 1 by the side panel 16 folded contiguously with a back-side top panel 14*b*, and by the second top sealing panel 22 folded contiguously with the back-side top sealing panel 20*b*. As a result, the width W4 of the tubular body 3 is substantially equal to the width W3 of the back-side top sealing panel 20*b*.

Thus, the width W1 of the front-side top sealing panel 20*a* is larger than the width W2 of the tubular body by an amount four times as large as the thickness of the carton blank 2. Further, each of the front-side top sealing vertical folding lines 23 can be located more on the outer side in the right-and-left direction than the outer surface of the left side panel 9 or the right side panel 10 of the tubular body 3 by an amount twice as large as the thickness of the carton blank 2. With this configuration, while the width W1 of the front-side top sealing panel 20*a* and the difference between the width W3 of the back-side top sealing panel 20*b* and the width W2 of the body front panel are reduced, the position of each of the front-side top sealing vertical folding lines 23 can be closer to the apex of the folding-down corner portion of the flap 35. Thus, the flap 35 can easily be folded down, thereby being capable of reducing the repulsive force against folding down of the flap 35.

According to the paper container 1 of the third example configured as described above, the width W1 of the front-side top sealing panel 20*a* is larger than the width W2 of the body front panel 8, and the width W3 of the back-side top sealing panel 20*b* is smaller than the width W2 of the body front panel 8 in the right-and-left direction. Accordingly, at the position at which the top sealing panels 20 overlap each other when the flap 35 is folded down, the body left side panel 9 or the body right side panel 10 is pushed inward so that the width W4 of the tubular body 3 is reduced. As a result, there can easily be obtained the front-side top sealing panel 20*a* having the width larger than the width W3 of the back-side top sealing panel 20*b* and the width W2 of the tubular body 3. Further, the position of each of the front-side top sealing vertical folding lines 23 can be close to the apex of the folding-down corner portion of the flap 35, which is located more on the outer side in the right-and-left direction than the back-side top sealing vertical folding line 24 and the outer surface of the left side panel 9 or the right side panel 10 of the tubular body. Thus, the flap 35 can easily be folded down, thereby being capable of reducing the repulsive force against folding down of the flap 35.

Further, even when the front-side top panel vertical folding lines 17 and the back-side top panel vertical folding lines 18 have small inclinations, the position of each of the front-side top sealing vertical folding lines 23 can be close to the apex of the folding-down corner portion of the flap 35, which is located more on the outer side in the right-and-left direction than the outer surface of the left side panel 9 or the right side panel 10 of the tubular body. Thus, deformation of the shape of the paper container 1 can be suppressed.

Further, the left side panel 9 and the right side panel 10 of the tubular body 3 are pushed inward, thereby being capable of suppressing a bulge of the body of the paper container 1.

Further, in the third example, as each of the back-side top panel vertical folding lines 18 extends toward the first top sealing panel 20, the position of each of the back-side top panel vertical folding lines 18 is gradually shifted more on the inner side in the right-and-left direction than the outer surface of the left side panel 9 or the right side panel 10 of the tubular body 3, and each of the side panels pushes the left side panel 9 or the right side panel 10 of the tubular body 3 inward over a wide range. Therefore, the bulge of the body of the paper container 1 can more effectively be suppressed.

The other effects are the same as those given in the first example. Accordingly, description thereof is also applied to description of the third example, and redundant description is omitted.

Figure 18:
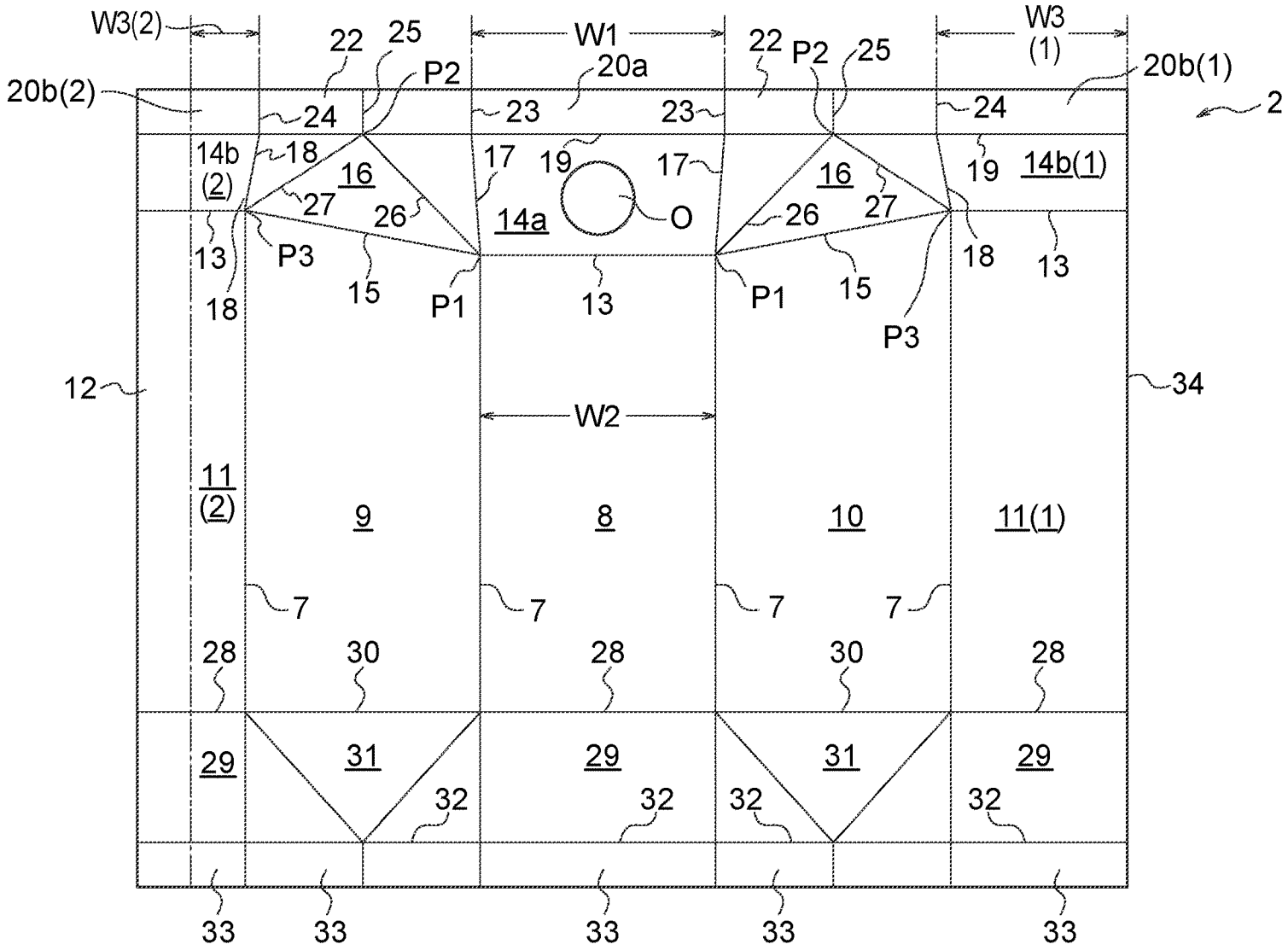
FIG. 18 is a developed view for illustrating a fourth example of the paper container according to the embodiment of the present invention.
Figure 19:
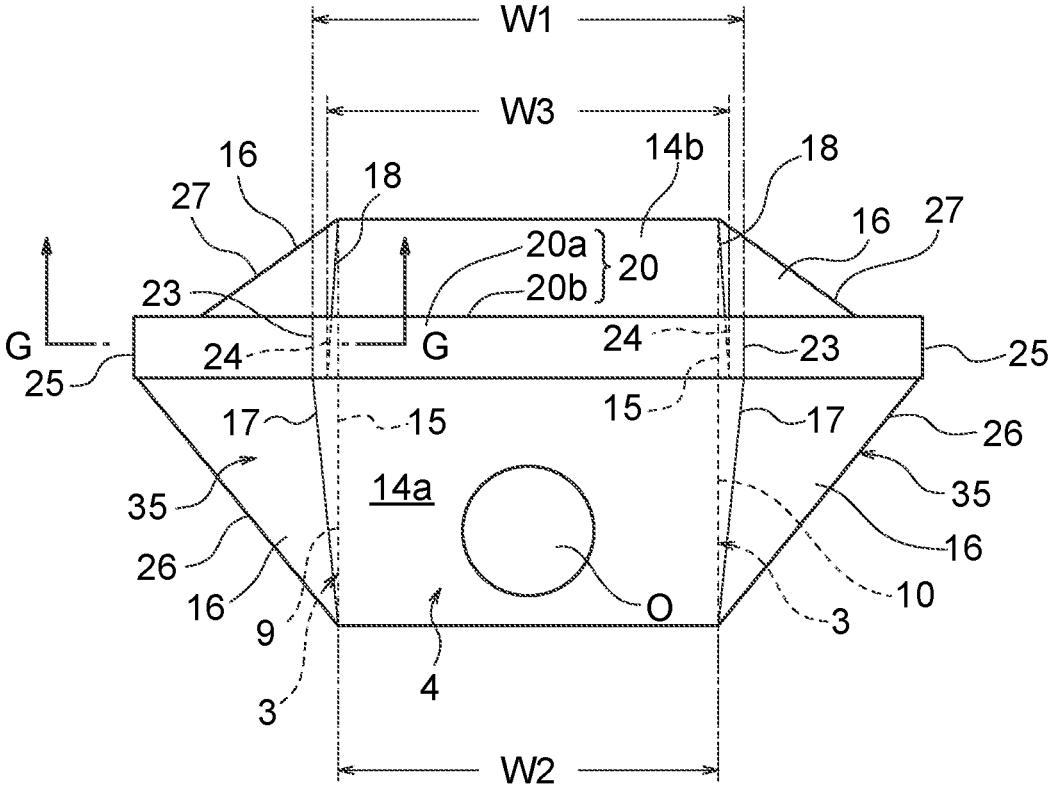
FIG. 19 is a plan view for illustrating a state in which the top sealing panels of the paper container of the fourth example are folded down.
Figure 20:
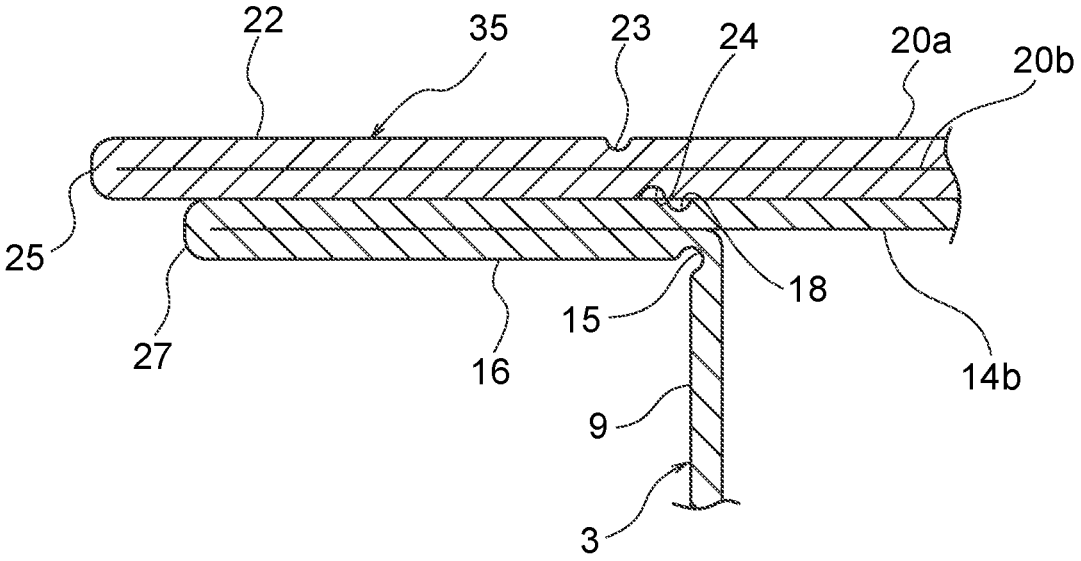
FIG. 20 is a partially omitted enlarged end surface view taken along the line G-G of FIG. 19.
Figure 21:
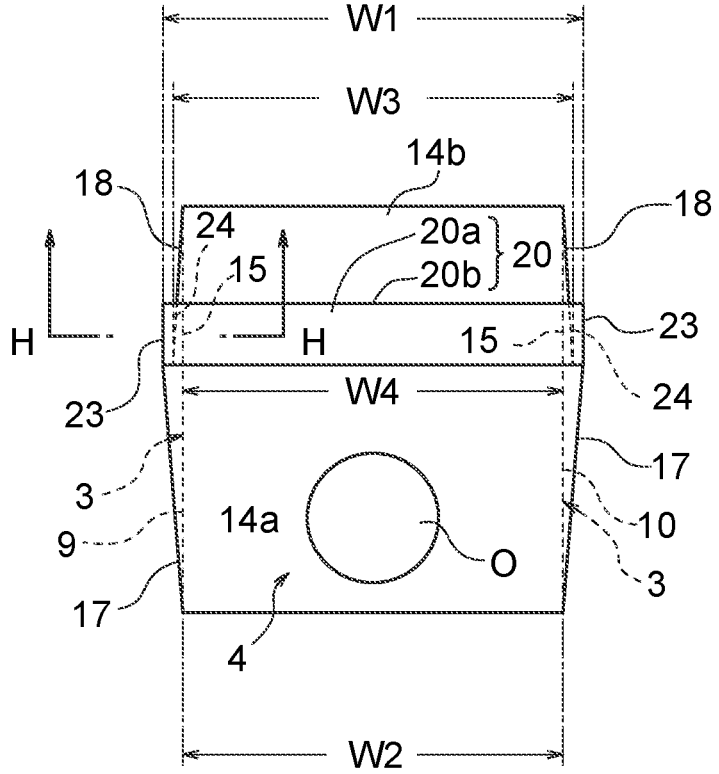
FIG. 21 is a plan view for illustrating a state in which the flaps are folded down on the side surfaces from the state illustrated in FIG. 19.
Figure 22:
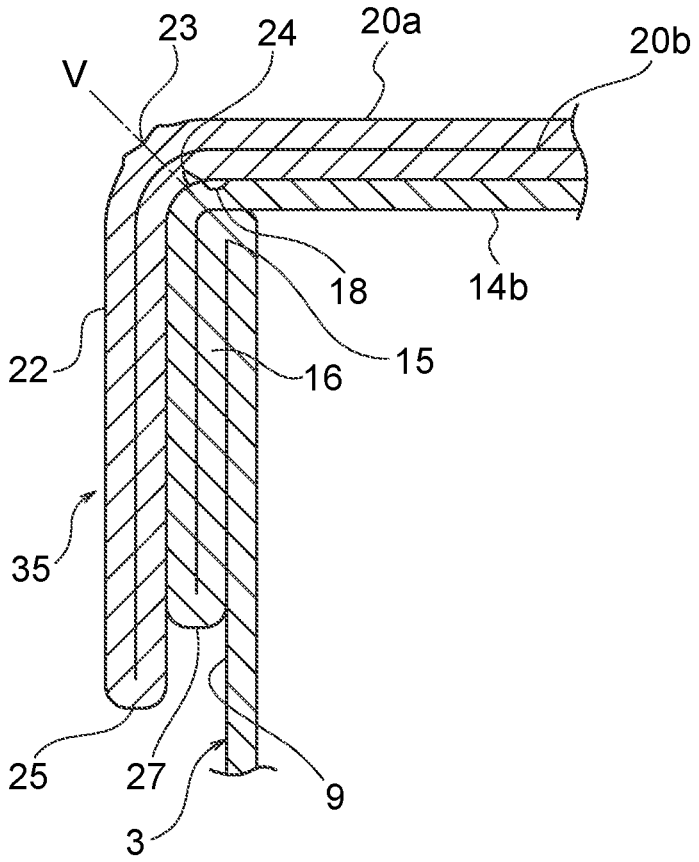
FIG. 22 is a partially omitted enlarged end surface view taken along the line H-H of FIG. 21.

FIG. 18 to FIG. 22 are illustrations of a fourth example of the paper container according to the embodiment of the present invention. FIG. 18 is a developed view for illustrating the fourth example of the paper container according to the embodiment of the present invention. FIG. 19 is a plan view for illustrating a state in which the top sealing panels of the paper container of the fourth example are folded down. FIG. 20 is a partially omitted enlarged end surface view taken along the line G-G of FIG. 19. FIG. 21 is a plan view for illustrating a state in which the flaps are folded down on the side surfaces from the state illustrated in FIG. 19. FIG. 22 is a partially omitted enlarged end surface view taken along the line H-H of FIG. 21.

The same configurations of the paper container of the fourth example as those of the first example are denoted by the same reference symbols, and the description thereof is omitted. Only configurations different from those of the first example are described.

The paper container of the fourth example is different from the paper container of the first example in configurations of the front-side top panel vertical folding lines 17, the back-side top panel vertical folding lines 18, the front-side top sealing panel 20*a*, and the back-side top sealing panel 20*b*.

In the carton blank 2 of the fourth example, as illustrated in FIG. 18, the front-side top panel vertical folding lines 17 extend obliquely so as to gradually increase the interval between the front-side top panel vertical folding lines 17 from the body front panel side toward the first top sealing panel 20, and are formed so as to join with the front-side top sealing vertical folding lines 23, respectively.

Further, the back-side top panel vertical folding lines 18 extend obliquely so as to gradually increase the interval between the back-side top panel vertical folding lines 18 from the back side toward the first top sealing panel 20, and are formed so as to join with the back-side top sealing vertical folding lines 24, respectively.

Inclination angles of the front-side top panel vertical folding line 17 and the back-side top panel vertical folding line 18 of the fourth example are not particularly limited as long as the inclination angles provide a configuration in which, at a position at which the top sealing panels are bonded together, the front-side top sealing vertical folding line 23 continuous with the front-side top panel vertical folding line 17 is located more on the outer side in the right-and-left direction than the back-side top sealing vertical folding line 24 continuous with the back-side top panel vertical folding line 18. For example, the front-side top panel vertical folding line 17 may have a large inclination, and the back-side top panel vertical folding line 18 may have a small inclination. Further, the top portion 4 of the paper container 1 of the fourth example forms the inclined surface, and hence the front-side top panel vertical folding line 17 is longer than the back-side top panel vertical folding line 18. Accordingly, even when the front-side top panel vertical folding line 17 and the back-side top panel vertical folding line 18 have the same inclination angle, the front-side top sealing vertical folding line 23 can be located more on the outer side in the right-and-left direction than the back-side top sealing vertical folding line 24.

Further, it is preferred that the inclination angle of the front-side top panel vertical folding line 17 and the inclination angle of the back-side top panel vertical folding line 18 be equal to or larger than 1° and equal to or smaller than 5°.

The width W1 of the front-side top sealing panel 20*a* is larger than the width W2 of the body front panel 8 and the width W3 of the back-side top sealing panel 20*b*.

The width W3 of the back-side top sealing panel 20*b* is larger than the width W2 of the body front panel 8 and the body back panel 11.

It is preferred that a difference D5 between the width W1 of the front-side top sealing panel 20*a* and the width W3 of the back-side top sealing panel 20*b* be equal to or larger than an amount twice as large as the thickness of the carton blank 2, and it is preferred that a difference D6 between the width W1 of the front-side top sealing panel 20*a* and the width W2 of the body front panel 8 be equal to or smaller than an amount six times as large as the thickness of the carton blank 2.

Further, it is preferred that a difference D7 between the width W3 of the back-side top sealing panel 20*b* in the right-and-left direction and the width W2 of the body front panel 8 be equal to or larger than an amount twice as large as the thickness of the carton blank 2 and equal to or smaller than an amount four times as large as the thickness of the carton blank 2.

In the fourth example, the difference D5 is set to an amount twice as large as the thickness of the carton blank 2, and the difference D6 is set to an amount four times as large as the thickness of the carton blank 2. Further, the difference D7 is set to an amount twice as large as the thickness of the carton blank 2.

The other configurations are the same as those of the first example. Accordingly, description thereof is also applied to description of the fourth example, and redundant description is omitted.

For assembly of the paper container 1 from the carton blank 2 formed as described above, first, the carton blank is folded along the body vertical folding lines 7, and the opening edge 34 of the carton blank 2 in the width direction thereof is bonded to the vertical direction sealing panel 12, thereby forming the quadrangular tubular body 3. Then, the bottom sealing panels 33 are bonded together to seal the opening of the bottom portion of the tubular body 3. The carton blank is folded along the bottom horizontal folding lines 28 and 30, and the outer bottom panels 29 and the inner bottom panels 31 are folded and bonded together, thereby forming the bottom portion 5.

When the bottom portion 5 is formed, a liquid is filled into the paper container 1 through the upper opening of the tubular body 3.

When the liquid is filled in, as illustrated in FIG. 19, the second top sealing panels are folded along the side top sealing vertical folding lines 25. The opposing surfaces of the first top sealing panels 20 are bonded together, and the opposing surfaces of the second top sealing panels 22 are bonded together. The carton blank is folded along the first side panel folding lines 26 and the second side panel folding lines 27, thereby forming the top portion 4 having a flat surface, and forming the flaps 35 each having a triangular shape. Then, the bonded top seal panels are folded down to the back side.

At this time, as illustrated in FIG. 19, the width W1 of the front-side top sealing panel 20*a* is larger than the width W2 of the body front panel 8 by an amount four times as large as the thickness of the carton blank, and hence is larger than the width W4 of the tubular body 3 by an amount four times as large as the thickness of the carton blank. Accordingly, each of the left and right front-side top sealing vertical folding lines 23 is located more on the outer side in the right-and-left direction than the outer surface of the left side panel 9 or the right side panel 10 of the tubular body 3 by an amount twice as large as the thickness of the carton blank 2. Further, the width W1 of the front-side top sealing panel 20*a* is larger than the width W3 of the back-side top sealing panel 20*b* by an amount twice as large as the thickness of the carton blank 2. Accordingly, each of the right and left front-side top sealing vertical folding lines 23 is located more on the outer side in the right-and-left direction than each of the right and left back-side top sealing vertical folding lines 24 by an amount equal to the thickness of the carton blank 2. The width W3 of the back-side top sealing panel 20*b* is larger than the width W2 of the body front panel 8 by an amount twice as large as the thickness of the carton blank 2. Accordingly, each of the left and right back-side top sealing vertical folding lines 24 is located more on the outer side in the right-and-left direction than the outer surface of the left side panel 9 or the right side panel 10 of the tubular body 3 by an amount equal to the thickness of the carton blank 2.

Further, in the fourth example, the front-side top panel vertical folding lines 17 extend obliquely so as to gradually increase the interval between the front-side top panel vertical folding lines 17 from the front side toward the first top sealing panel 20. Accordingly, a position of each of the front-side top panel vertical folding lines 17 is gradually shifted more on the outer side in the right-and-left direction than the outer surface of the left side panel 9 or the right side panel 10 of the tubular body 3 as each of the front-side top panel vertical folding lines 17 extends toward the first top sealing panel 20.

Under this state, as illustrated in FIG. 21, the carton blank is mountain-folded along the front-side top panel vertical folding lines 17, the back-side top panel vertical folding lines 18, and the front-side top sealing vertical folding lines 23, and the carton blank is valley-folded along the second top portion horizontal folding lines 15 and the back-side top sealing vertical folding lines 24. Thus, the flaps 35 are folded down onto right and left side surfaces of the tubular body 3.

At this time, as illustrated in FIG. 22, each of the left and right front-side top sealing vertical folding lines 23 is located more on the outer side in the right-and-left direction than the outer surface of the left side panel 9 or the right side panel 10 of the tubular body by an amount twice as large as the thickness of the carton blank 2. Accordingly, the position of each of the front-side top sealing vertical folding lines 23 is close to the apex of the folding-down corner portion of the flap 35. Thus, the flap 35 can easily be folded down, thereby being capable of reducing the repulsive force against folding down of the flap 35.

Further, each of the left and right back-side top sealing vertical folding lines 24 is located more on the inner side in the right-and-left direction than each of the left and right front-side top sealing vertical folding lines 23 by an amount equal to the thickness of the carton blank 2, and is located more on the outer side in the right-and-left direction than the outer surface of the left side panel 9 or the right side panel 10 of the tubular body by an amount equal to the thickness of the carton blank 2. Accordingly, without hindering folding along the front-side top sealing vertical folding line 23, the position of each of the back-side top sealing vertical folding lines 24 is close to the apex of the folding-down corner portion of the flap 35. Thus, the flap 35 can more easily be folded down, thereby being capable of further reducing the repulsive force against folding down of the flap 35.

Moreover, in the fourth example, as each of the front-side top panel vertical folding lines 17 extends toward the first top sealing panel 20, the position of each of the front-side top panel vertical folding lines 17 becomes gradually closer to the apex of the folding-down corner portion of the flap 35, which is located more on the outer side in the right-and-left direction than the outer surface of the left side panel 9 or the right side panel 10 of the tubular body 3. Accordingly, the flap 35 can more easily be folded down, thereby being capable of further reducing the repulsive force against folding down of the flap 35.

According to the paper container 1 of the fourth example configured as described above, the width W1 of the front-side top sealing panel 20*a* in the right-and-left direction is larger than the width W4 of the tubular body 3 in the right-and-left direction. Further, the width W3 of the back-side top sealing panel 20*b* in the right-and-left direction is smaller than the width W1 of the front-side top sealing panel 20*a* in the right-and-left direction and larger than the width W4 of the tubular body 3 in the right-and-left direction. Accordingly, each of the left and right front-side top sealing vertical folding lines 23 and each of the left and right back-side top sealing vertical folding lines 24 are located more on the outer side in the right-and-left direction than the outer surface of the left side panel 9 or the right side panel 10 of the tubular body, and each of the right and left front-side top sealing vertical folding lines 23 is located more on the outer side in the right-and-left direction than each of the right and left back-side top sealing vertical folding lines 24. With this configuration, the front-side top sealing vertical folding line 23 and the back-side top sealing vertical folding line 24 can be aligned on the imaginary line V indicating the apex of the folding-down corner portion of the flap. Thus, folding down of the flap 35 is effectively facilitated, and repulsion against folding down of the flap 35 can be reduced.

The other effects are the same as those given in the first example. Accordingly, description thereof is also applied to description of the fourth example, and redundant description is omitted.

REFERENCE SIGNS LIST

1 paper container
2 carton blank
3 tubular body
4 top portion
5 bottom portion
6 spout
7 body vertical folding line
8 body front panel
9 body left side panel
10 body right side panel
11 body back panel
12 vertical direction sealing panel
13 first top portion horizontal folding line
14 top panel
14*a* front-side top panel
14*b* back-side top panel
15 second top portion horizontal folding line
16 side panel
17 front-side top panel vertical folding line
18 back-side top panel vertical folding line
19 top sealing horizontal folding line
20 first top sealing panel
20*a* front-side top sealing panel
20*b* back-side top sealing panel
21 top sealing horizontal folding line
22 second top sealing panel
23 front-side top sealing vertical folding line
24 back-side top sealing vertical folding line
25 side top sealing vertical folding line
26 first side panel folding line
27 second side panel folding line
28 bottom horizontal folding line
29 outer bottom panel
30 bottom horizontal folding line
31 inner bottom panel
32 bottom sealing horizontal folding line
33 bottom sealing panel
34 opening edge
35 flap
O opening
P1, P2, P3 intersection
W1, W2, W3, W4 width
V imaginary line

The invention claimed is:

1. A paper container, comprising:

a body front panel, a body right side panel, a body left side panel, and a body back panel, which are contiguous through body vertical folding lines;

a vertical direction sealing panel configured to form a rectangular tubular body together with the body front panel, the body right side panel, the body left side panel and the body back panel;

a front-side top panel and a back-side top panel contiguous with an upper end of the body front panel and an upper end of the body back panel so as to be opposed to the body front panel and the body back panel through first top portion horizontal folding lines, respectively;

a pair of side panels contiguous with an upper end of the body right side panel and an upper end of the body left side panel so as to be opposed to the body right side panel and the body left side panel through second top portion horizontal folding lines, respectively, the front-side top panel being contiguous with the pair of side panels through respective front-side top panel vertical folding lines, the back-side top panel being contiguous with the pair of side panels through respective back-side top panel vertical folding lines;

a pair of first top sealing panels comprising a front-side top sealing panel and a back-side top sealing panel contiguous with upper ends of the front-side top panel and the back-side top panel so as to be opposed to the front-side top panel and the back-side top panel through first top sealing horizontal folding lines, respectively; and second top sealing panels contiguous with upper ends of the pair of side panels so as to be opposed to the pair of side panels through second top sealing horizontal folding lines, respectively, the front-side top sealing panel being contiguous with the second top sealing panels through respective front-side top sealing vertical folding lines, and the back-side top sealing panel being contiguous with the second top sealing panels through respective back-side top sealing vertical folding lines, the second top sealing panels each having a side top sealing vertical folding line extending from an upper end of the second top sealing panel to a respective one of the second top sealing horizontal folding lines, each side panel of the pair of side panels having a first side panel folding line extending from an intersection of one of the body vertical folding lines adjacent to the body front panel and a front-side end portion of the second top portion horizontal folding line, to an intersection of the second top sealing horizontal folding line and the side top sealing vertical folding line, and a second side panel folding line extending from an intersection of one of the body vertical folding lines adjacent to the body back panel and a back-side end portion of the second top portion horizontal folding line, to the intersection of the second top sealing horizontal folding line and the side top sealing vertical folding line, the second top sealing panels being folded along the side top sealing vertical folding lines so as to tightly close a top portion by bonding together opposing surfaces of the pair of first top sealing panels and opposing surfaces of the pair of second top sealing panels, each of the side panels being folded along the first side panel folding line and the second side panel folding line to form a flap having a substantially triangular shape, the top portion being formed by respectively folding down the flaps onto right and left side surfaces of the tubular body through mountain-folding along the front-side and back-side top panel vertical folding lines and the front-side top sealing vertical folding lines, and through valley-folding along the second top portion horizontal folding lines and the back-side top sealing vertical folding lines, wherein a width of the front-side top sealing panel extends in a right-and-left direction of the paper container from one of the front-side top sealing vertical folding lines to the other of the front-side top sealing vertical folding lines, and the width of the front-side top sealing panel is larger than a width of the first top portion horizontal folding lines.

2. The paper container according to claim 1, wherein the width of the front-side top sealing panel in the right-and-left direction is larger than a width of the back-side top sealing panel in the right-and-left direction.

3. The paper container according to claim 1, wherein the front-side top panel vertical folding lines extend obliquely so as to gradually increase an interval between the front-side top panel vertical folding lines from the body front panel side toward the front-side top sealing panel, and join with the front-side top sealing vertical folding lines, respectively.

4. The paper container according to claim 1, wherein a width of the back-side top sealing panel in the right-and-left direction is smaller than the width of the first top portion horizontal folding lines.

5. The paper container according to claim 4, wherein the back-side top panel vertical folding lines extend obliquely so as to gradually decrease an interval between the back-side top panel vertical folding lines from the body back panel side toward the back-side top sealing panel, and join with the back-side top sealing vertical folding lines, respectively.

6. The paper container according to claim 1, wherein a width of the back-side top sealing panel in the right-and-left direction is larger than the width of the first top portion horizontal folding lines.

7. The paper container according to claim 6, wherein the back-side top panel vertical folding lines extend obliquely so as to gradually increase an interval between the back-side top panel vertical folding lines from the body back panel side toward the back-side top sealing panel, and join with the back-side top sealing vertical folding lines, respectively.

* * * * *